US007734218B2

(12) United States Patent
Oohata et al.

(10) Patent No.: US 7,734,218 B2
(45) Date of Patent: Jun. 8, 2010

(54) COVER-BODY LOCKING CONSTRUCTION AND IMAGE FORMING APPARATUS PROVIDED WITH SUCH LOCKING CONSTRUCTION

(75) Inventors: Shinobu Oohata, Osaka (JP); Yuki Shiga, Osaka (JP)

(73) Assignee: Kyocera Mita Corporation (JP)

( * ) Notice: Subject to any disclaimer, the term of this patent is extended or adjusted under 35 U.S.C. 154(b) by 858 days.

(21) Appl. No.: 11/590,728

(22) Filed: Oct. 31, 2006

(65) Prior Publication Data

US 2007/0098441 A1 May 3, 2007

(30) Foreign Application Priority Data

Oct. 31, 2005 (JP) ..... 2005-317497

(51) Int. Cl.
*G03G 21/00* (2006.01)

(52) U.S. Cl. ..... 399/122; 399/124

(58) Field of Classification Search ..... 399/122, 399/124, 405

See application file for complete search history.

(56) References Cited

FOREIGN PATENT DOCUMENTS

JP 2005-241840 9/2005
JP 2005315920 A * 11/2005

* cited by examiner

*Primary Examiner*—David M Gray
*Assistant Examiner*—Laura K Roth
(74) *Attorney, Agent, or Firm*—Gerald E. Hespos; Michael J. Porco

(57) ABSTRACT

A cover-body locking construction includes a specified housing, a frame insertable into and withdrawable from the housing, a structure supported on the frame, and a cover body shiftable between a covering position to cover at least part of the structure and an exposing position to expose the at least part of the structure to the outside by canceling the covered state with the structure withdrawn from the housing. The cover body includes a locking member having a locking portion for locking the cover body set at the covering position into the frame and an operating portion for causing the locking portion to lock and unlock. The housing includes a lock guiding member shaped to interlock the locking portion with the frame due to the interference with the cover body and the operating portion upon inserting the frame into the housing with the structure covered by the cover body.

4 Claims, 18 Drawing Sheets

+Y
+X
-X
-Y

17(171)
172
21(20)
210
211
90
91
92
93
172b
22
32
43
111
63
46
80
60
50
40
30
70
61
86(84)
62
34
31
411a
431
S2
71
72
73
75
85
86
84
83
44
33
81
82
S1

+Y
-Y
+X
-X
95
113
951
951a
951b
955
955a
955b
44
33
34
17
172
171
172b
321
171(172)
30
31
32
40

+Y
-Y
+X
-X
17
95
955
951
113
951a
951b
44
34
33
172b
32
40

+Y
+X
-X
-Y
17(171)
172
21(20)
210
90
92
851
211
54
22
63
43
44
33
88
76
80
60
70'
50
40
30'
111
112
83
81
882
881

COVER-BODY LOCKING CONSTRUCTION AND IMAGE FORMING APPARATUS PROVIDED WITH SUCH LOCKING CONSTRUCTION

BACKGROUND OF THE INVENTION

1. Field of the Invention

The present invention relates to a cover-body locking construction for locking a covering state of a cover body provided to cover a structure detachably mounted into a specified housing, and an image forming apparatus provided with such a construction.

2. Description of the Related Art

An image forming apparatus as disclosed in Japanese Unexamined Patent Publication No. 2005-241840 is conventionally known. This image forming apparatus is used as a so-called copier for reading an image of a document by means of an image reader provided atop a box-shaped housing and transferring a toner image to a sheet based on the read image information. Such an image forming apparatus is provided in the housing with an image forming assembly including a photoconductive drum, a charger, an exposing device and a developing device, a fixing section including a fixing device comprised of a heating roller and a pressure roller whose outer circumferential surfaces are opposed to each other, and a sheet feeding section for storing sheets to be fed to the image forming section. A beam modulated based on the document image optically read by the image reader and emitted from the exposing device is device is projected onto the outer circumferential surface of the photoconductive drum rotating about its central axis and uniformly charged by the charger, thereby forming an electrostatic latent image on the outer circumferential surface of the photoconductive drum. The toner image is formed by supplying toner toward this electrostatic latent image from the developing device, and is transferred to a sheet fed from the sheet feeding section. The sheet after the transferring operation has the toner image fixed thereto by heating upon passing a nip between the heating roller and the pressure roller in the fixing device. The sheet after the image fixing operation is discharged onto a discharge tray provided on an outer wall of the housing.

In such an image forming apparatus, the respective devices such as the charger and the exposing device are formed into units together with accessories. These units are detachably mountable into the housing via specified frames. Various maintenance operations such as maintenance and inspection, exchange and jammed paper removal can be easily carried out by withdrawing the frames from the housing.

In the image forming apparatus of the above publication, the charger formed into a unit together with its accessories is also detachably mountable into the frame. Such a charger unit is fixed in the frame by a specified locking construction while being mounted at a position right above the photoconductive drum in the photoconductive drum in the frame. The locking construction is comprised of a hook portion provided at the other end of a fixed lever having one end thereof mounted on one lateral part of the frame in such a manner as to be rotatable about a shaft, and a locking portion provided at a position of the frame corresponding to the hook portion so as to be engageable with the hook portion. By pressing the fixed lever downward with the hook portion opposed to the locking portion, the hook portion is engaged with the locking portion after the fixed lever temporarily undergoes an elastic deformation to be deflected.

Accordingly, the fixed lever is elastically deformed to fit the hook portion into the locking portion to be engaged by strongly pressing the fixed lever downward after the charger unit is placed on the frame with the frame withdrawn from the housing and the fixed lever is turned about the shaft to press the charging unit. In this way, the charger unit is fixed to the frame. The charger unit is mounted into the housing by pushing the frame having the charger unit fixed thereto into the housing.

However, with this locking construction, there are cases where the hook portion of the fixed lever cannot be engaged with the locking portion of the frame due to an insufficient pressing force despite a downward pressing operation of the fixed lever to fix the charger unit to the frame withdrawn from the housing. Unless the hook portion is engaged with the locking portion, the engaged with the locking portion, the charger unit cannot be securely fixed by the fixed lever. If the frame should be pushed into the housing in such a state, the charger unit would be quite unstably mounted in the housing. Hence, the charger unit cannot properly give electric charges to the outer circumferential surface of the photoconductive drum during the later operation of the image forming apparatus, thereby causing such an inconvenience as to hinder the proper image forming operation.

Although an occurrence of such an inconvenience is described, taking the charger unit as an example with reference to the above patent publication, it is not limited to charger units. This holds for other devices such as developing devices and fixing devices provided that they are formed into units, detachably mountable into a frame, and a cover body is provided.

SUMMARY OF THE INVENTION

An object of the present invention is to provide a cover-body locking construction capable of securely locking a covering state of a cover body provided to cover a structure detachably mounted into a specified housing, and an image forming apparatus provided with such a locking construction.

One aspect of the present invention developed to accomplish the above object is directed to a cover-body locking construction, comprising a specified housing; a frame insertable into and withdrawable from the housing; a structure supported on the frame; and a cover body shiftable between a covering position to cover at least part of the structure and an exposing position to expose the at least part of the structure to the outside by canceling the covered state with the structure withdrawn from the housing, wherein the cover body includes a locking member having a locking portion for locking the cover body set at the covering position into the frame and an operating portion for causing the locking portion to lock and unlock; and the housing includes a lock guiding member shaped to interlock the locking portion with the frame due to the interference with the cover body and the operating portion upon inserting the frame into the housing with the structure covered by the cover body.

Another aspect of the present invention developed to accomplish the above object is directed to an image forming apparatus, comprising an apparatus main body having a housing structure; a frame withdrawable from the apparatus main body; a fixing device supported on the frame; and a cover body shiftable between a covering position to cover at least part of the fixing device and an exposing position to expose the at least part of the fixing device to the outside by canceling the covered state with the fixing device withdrawn from the apparatus main body, wherein the cover body includes a locking member having a locking portion for locking the cover body set at the covering position into the position into the frame and an operating portion for causing the locking portion to lock and unlock; and the apparatus main body includes a lock guiding member shaped to interlock the locking portion with the frame due to the interference with the cover body and the operating portion upon inserting the frame into the apparatus main body with the fixing device covered by the cover body.

BRIEF DESCRIPTION OF THE DRAWINGS

FIGS. 6A and 6B are assembled perspective views showing the cover unit of FIG. 5, wherein FIG. 6A shows a state where the the cover unit is set at a covering position to cover a downstream side of a fixing device, and FIG. 6B shows a state where the cover unit is set at an exposing position to expose the downstream side of the fixing device.

FIGS. 7 to 10 are diagrams showing functions of the cover unit, wherein FIG. 7 shows a state where the cover unit is extended and set at the covering position S1 to cover the downstream side of the fixing device, FIG. 8 shows a state where it is started to withdraw the cover unit from the apparatus main body, FIG. 9 shows a state where the cover unit is inclined immediately after a third shaft comes out of an arcuate guide groove, and FIG. 10 shows a state where the cover unit is completely withdrawn and set at the exposing position to expose the downstream side of the fixing device.

FIGS. 12A to 12C are perspective views showing one embodiment of the lock guiding member, wherein FIG. 12A shows a state immediately before the lock guiding member is mounted on a ceiling frame when viewed obliquely from above, FIG. 12B shows a state where the lock guiding member is mounted on the ceiling frame when viewed obliquely from above, and FIG. 12C shows the state shown in FIG. 12B when viewed obliquely from below.

FIGS. 17A and 17B are assembled perspective views showing the cover unit shown in FIG. 16, wherein FIG. 17A shows a state where the cover unit is set at an accommodated position in the apparatus main body, and FIG. 17B shows a state where the cover unit is withdrawn from the accommodated position in the apparatus main body.

FIGS. 18A and 18B are perspective views showing the function of a position changing construction for a covering member, wherein FIG. 18A shows a state where the covering member is set at a retracted position and FIG. 18B shows a state where the covering member is set at a covering position.

DETAILED DESCRIPTION OF THE PREFERRED EMBODIMENTS

Figure 1:
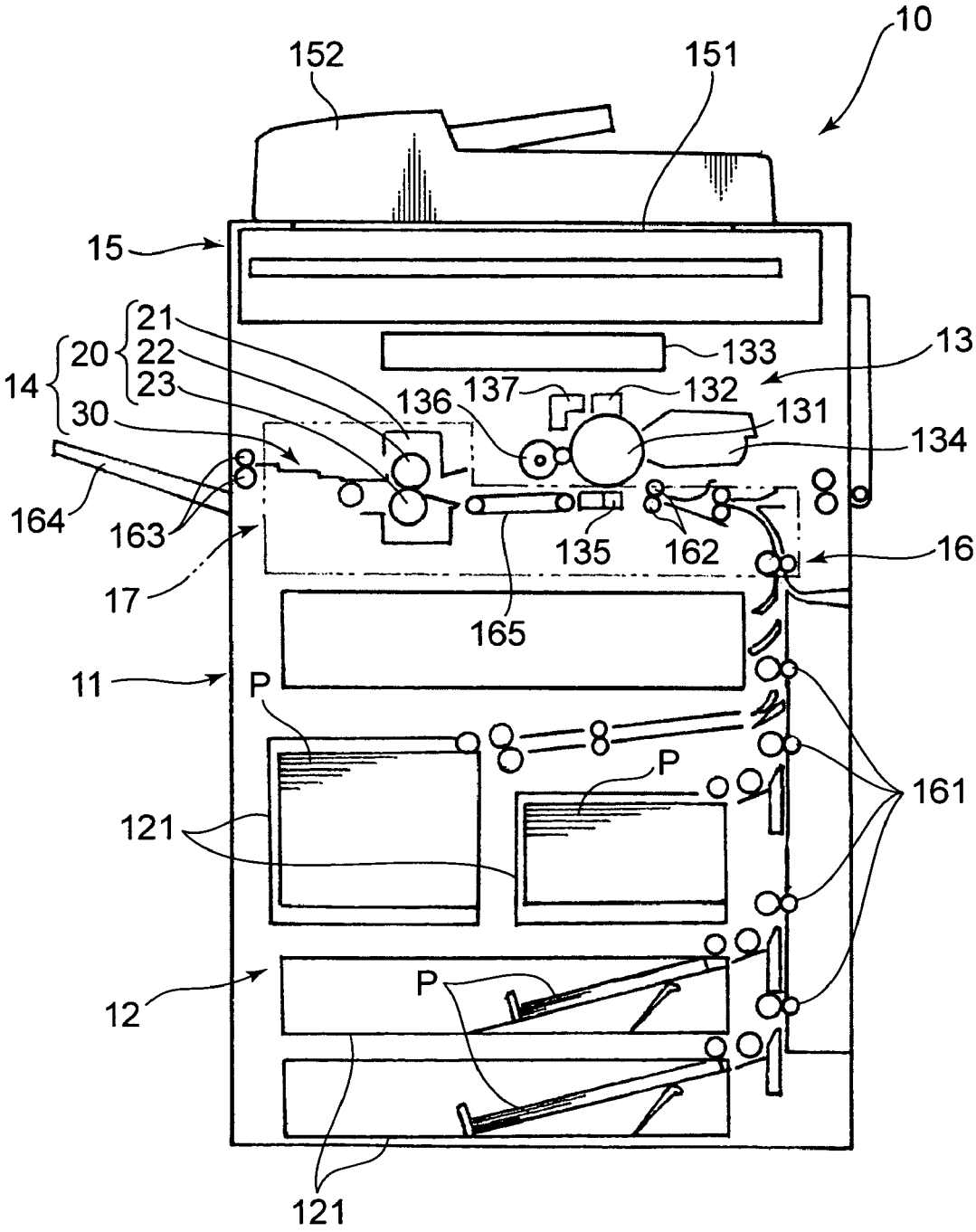
FIG. 1 is a diagram outlining the internal construction of one embodiment of an image forming apparatus according to the present invention.

Hereinafter, one embodiment of the present invention is described in detail with reference to the accompanying drawings. FIG. 1 is a diagram outlining the internal construction of one embodiment of an image forming apparatus as an apparatus to which a cover-body locking construction according to the present invention is applied. As shown in FIG. 1, a copier is taken as an example of the image forming apparatus 10 in this embodiment.

The image forming apparatus 10 is provided with a sheet feeding section 12 arranged at a bottom part of a box-shaped apparatus main body 11 (housing), an image forming section 13 arranged above the sheet feeding section 12, a fixing section 14 arranged to the left of the image forming section 13 in FIG. 1, an image reader 15 including optical members and arranged above the image forming section 13 and the fixing section 14, and a sheet conveyance assembly 16 extending from the sheet feeding section 12 to the sheet discharge via the image forming section 13 and the fixing section 14.

The image reader 15 is for reading the image information of a document by emitting a light from an unillustrated exposure lamp to the document placed on a contact glass 151 and introducing the reflected light to a photoelectrically converting unit via a reflecting mirror. This image information is transferred to an exposure unit 133 to be described later.

The sheet feeding section 12 is for feeding sheets P one by one from a stack of sheets P placed in sheet cassettes 121 to the sheet conveyance assembly 16. The sheet conveyance assembly 16 is for conveying a sheet P fed from the sheet feeding section 12 toward the image forming section 13 by means of a pair of conveyance rollers 161 and a pair of registration rollers 162, and discharges the sheet P onto a discharge tray 164 disposed on an outer wall of the apparatus main body 11 by the driving of a pair of discharge rollers 163 after the sheet passes the image forming section 13 and the fixing section 14.

The image forming section 13 is for transferring a specified toner image to the sheet P by an electrophotographic process. The image forming section 13 includes a photoconductive drum 131 rotatable about its central axis, a charger unit 132, the exposure unit 133, a developing unit 134, a transfer unit 135, a cleaner 136 and a charge removing unit 137, the units and devices 132 to 137 being arranged around the photoconductive drum 131 along a rotating direction of the photoconductive drum 131.

The charger unit 132 imparts a specified potential to the outer circumferential surface of the photoconductive drum 131 by the corona discharge. The exposure unit 133 emits a laser beam based on the image data of the document read by the image reader 15, which selectively attenuates the potential on the outer circumferential surface of the photoconductive drum 131 to form an 131 to form an electrostatic latent image on the outer circumferential surface of the photoconductive drum 131. The developing unit 134 forms a toner image on the outer circumferential surface of the photoconductive drum 131 by developing the electrostatic latent image with toner. The transfer unit 135 transfers the toner image on the outer circumferential surface of the photoconductive drum 131 to the sheet P. The cleaner 136 removes the toner residual on the outer circumferential surface of the photoconductive drum 131 after the image transfer operation. The charge removing unit 137 removes residual charges on the outer circumferential surface of the photoconductive drum 131.

The fixing section 14 fixes the toner image transferred to the sheet P in the image forming section 13 to the sheet P. The fixing section 14 includes a fixing device (structure) disposed downstream of the image forming section 13 with respect to a sheet conveying direction, and a cover unit (cover body) 30 disposed downstream of the fixing device 20 for guiding the sheet P coming out of the fixing device 20 toward the pair of discharge rollers 163. The fixing device 20 has a box-shaped fixing-device main body 21, a heat roller 22 supported on the fixing-device main body 21 in such a manner as to be rotatable about its central axis, and a pressure roller 23 having the outer circumferential surface thereof pressed into contact with that of the heating roller 22.

The sheet P conveyed from the image forming section 13 is conveyed by the rotation of the heating roller 22 and the pressure roller 23 while being sandwiched between these rollers 22, 23 in a nip therebetween. The toner image is fixed to the sheet P by heat from the heating roller 22. Thereafter, the sheet P is discharged toward the discharge tray 164 via the cover unit 30 and the pair of discharge rollers 163.

In this embodiment, a sheet conveyance unit 17 including part of the sheet conveyance assembly 16, the pair of registration rollers 162, the pair of discharge rollers 163, the fixing section 14 and the like and shown by chain double-dashed line in FIG. 1 is so provided as to be insertable into and withdrawn from the apparatus main body 11. Such a sheet conveyance unit 17 is provided to be insertable into and withdrawal from the apparatus main body 11 so that the removal of a jammed sheet and various maintenance operations can be easily carried out by withdrawing the sheet conveyance unit 17 from the apparatus main body 11.

Figure 2:
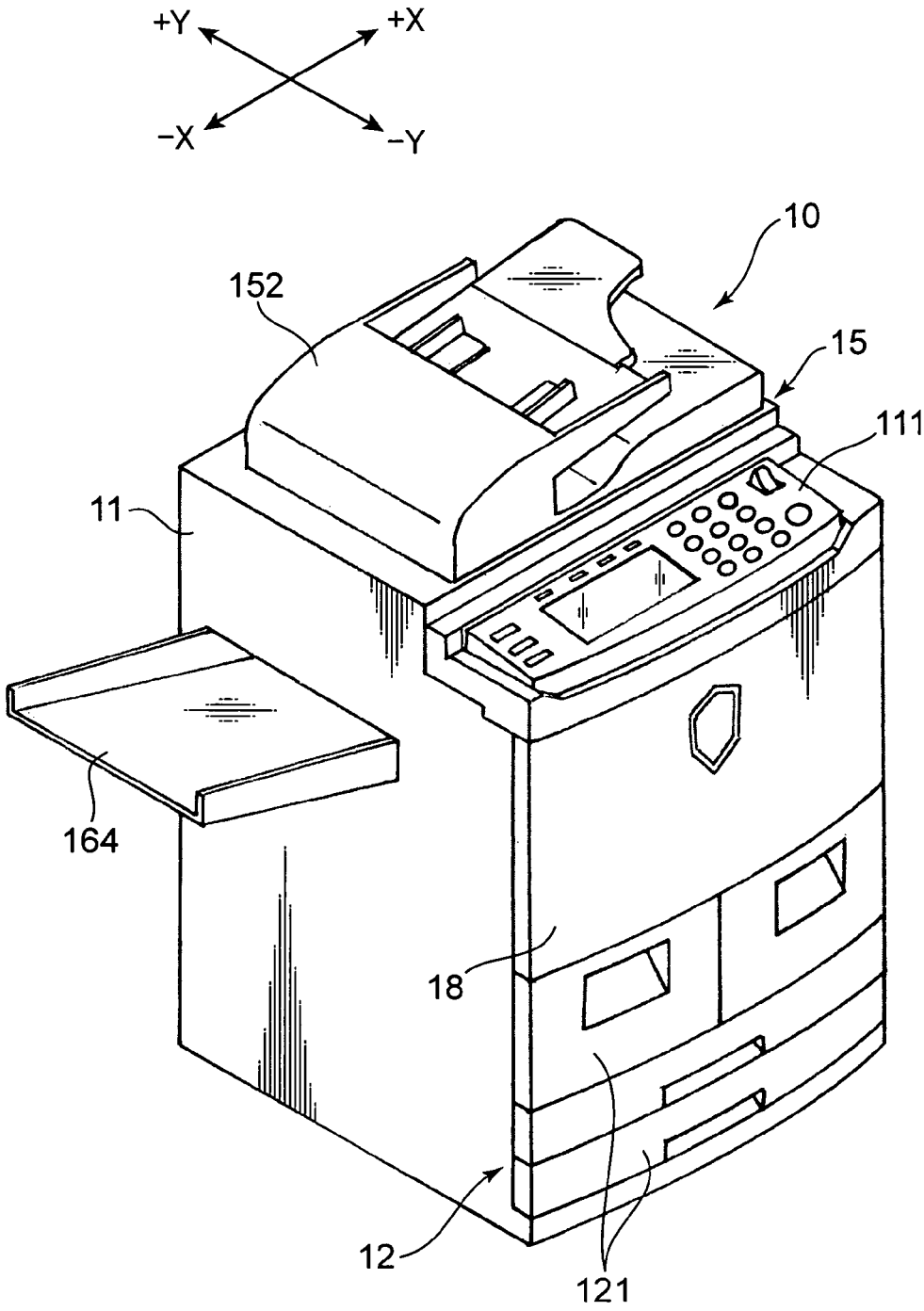
FIG. 2 is a perspective view showing one example of the external configuration of the image forming apparatus shown in FIG. 1 with a lid closed.
Figure 3:
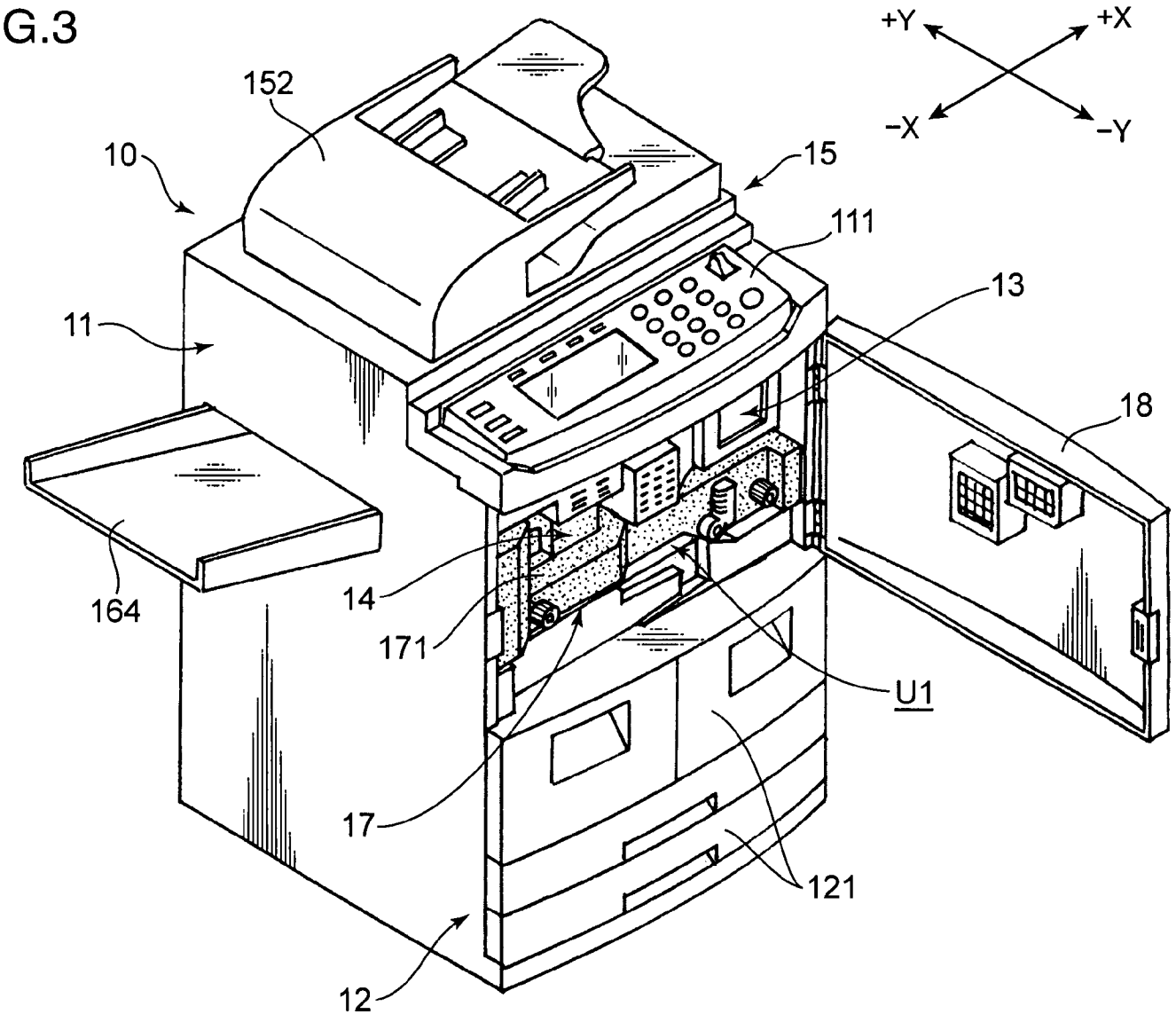
FIG. 3 is a perspective view showing a state where the lid is open and a sheet conveyance unit is accommodated in an apparatus main body (set at an accommodated position).
Figure 4:
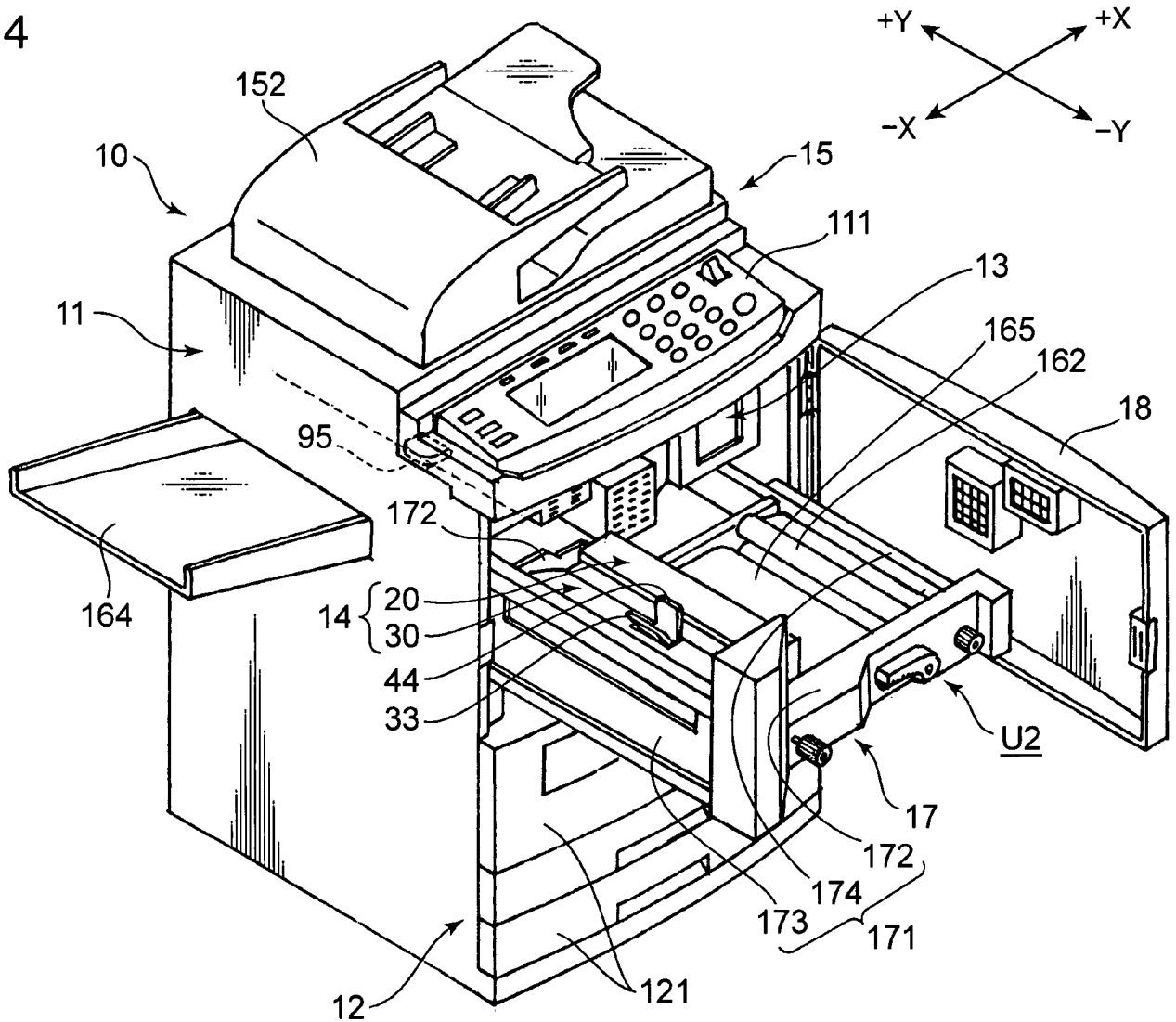
FIG. 4 is a perspective view showing a state where the sheet conveyance unit is withdrawn from the apparatus main body (set at a withdrawn position).

FIGS. 2 to 4 are perspective views showing the outer configuration of the image forming apparatus 10 shown in FIG. 1, wherein FIG. 2 shows a state where a lid 18 is closed, and FIGS. 3 and 4 show a state where the lid 18 is open. Particularly, FIG. 3 shows a state where the sheet conveyance unit 17 (shown by dots) is accommodated in the apparatus main body 11 (set at an accommodated position U1) and FIG. 4 shows a state where the sheet sheet conveyance unit 17 is withdrawn from the apparatus main body 11 (set at a withdrawn position U2). In FIGS. 2 to 4, X-X directions and Y-Y directions are referred to as transverse directions and forward and backward directions, respectively, wherein −X direction is leftward direction, +X direction rightward direction, −Y direction forward direction and +Y direction backward direction.

As shown in FIG. 2, in the image forming apparatus 10, the sheet feeding section 12 including a plurality of sheet cassettes 121 is arranged at the bottom part of the apparatus main body 11 in the form of a rectangular parallelepiped long in vertical direction. The respective sheet cassettes 121 are withdrawable forward. Further, the sheet conveyance unit 17 is mounted right above the sheet feeding section 12 in the apparatus main body 11, and the image forming section 13 is accommodated above the sheet conveyance unit 17 (see FIG. 3). An operation panel 111 including a numeric pad, a liquid crystal display, various operation keys and the like is provided at the front side of the ceiling plate of the apparatus main body 11. Further, an automatic document feeder 152 that can be opened to expose and closed to cover the contact glass 151 (see FIG. 1) is provided at the rear side of the ceiling plate.

The lid 18 openable and closeable along transverse direction is provided at a position of the front surface of such an apparatus main body 11 above the sheet feeding section 12. The lid 18 is normally closed as shown in FIG. 2, and is opened to the right as shown in FIGS. 3 and 4 upon the removable of a jammed sheet and various maintenance operations.

The sheet conveyance unit 17 is constructed by mounting such parts constituting the sheet conveyance assembly 16 as the pair of registration rollers 162 and a conveyance belt 165 disposed immediately downstream of the pair of registration rollers 162, the fixing device 20, the cover unit 30, and the like on a frame 171 that is L-shaped in front view as shown in FIGS. 3 and 4 (particularly in FIG. 3, the sheet conveyance unit 17 is shown by dots to be made easily distinguishable from other members). The sheet conveyance unit 17 is displaceable between the accommodated position U1 where it is accommodated in the apparatus main body 11 as shown in FIG. 3 and the withdrawn position U2 where it is withdrawn from the apparatus main body 11 as shown in FIG. 4.

The pair of registration rollers 162, the conveyance belt 165, the fixing device 20 and the cover unit 30 and the like are exposed to the outside as shown in FIG. 4 by withdrawing the frame 171 from the apparatus main body 11 to set the sheet conveyance unit 17 at the withdrawn position U2. Thus, a user can easily remove sheets jammed in these parts and carry out various maintenance operations such as the exchange of parts.

The frame 171 is box-shaped by having a pair of front and rear L-shaped frame elements 172, a left plate 173 bridging the vertically extending left ends of the L-shaped frame elements 172, and a right plate 174 bridging the right ends of the L-shaped frame elements 172. The pair of registration rollers 162, the conveyance belt 165, the fixing device 20, the cover unit 30 and the like are mounted in this box-shaped frame 171.

The cover unit 30 to be locked by the locking construction according to this embodiment is disposed immediately downstream (at the left side in FIG. 4) of the fixing device 20. The cover unit 30 functions to smoothly guide the sheet P coming out of the fixing device 20 after the image fixing operation toward the discharge tray 164. Hereinafter, the cover unit 30 is described in detail with reference to FIGS. 5 and 6.

Figure 5:
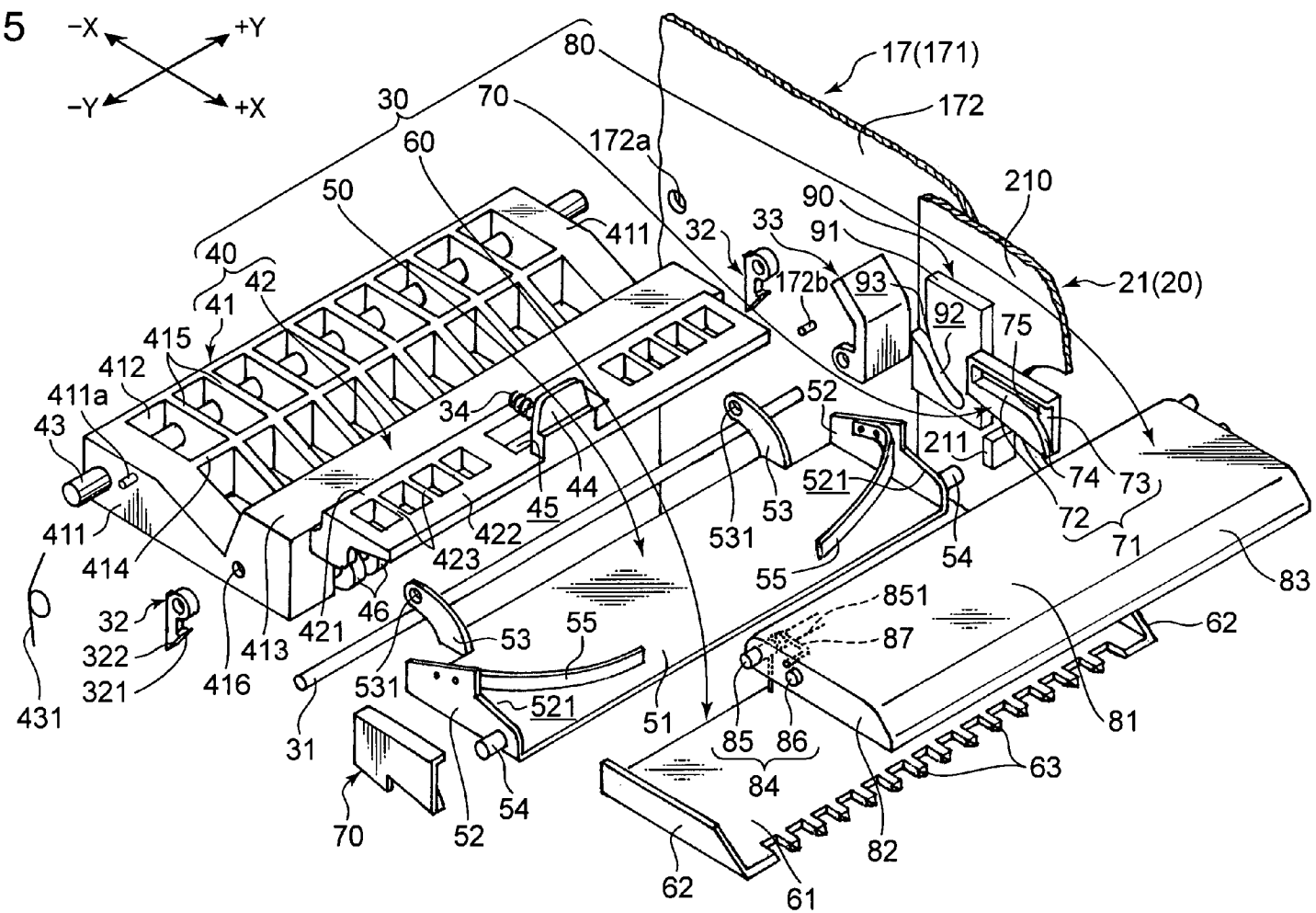
FIG. 5 is an exploded perspective view showing one embodiment of a cover unit.
Figures 6A, 6B:
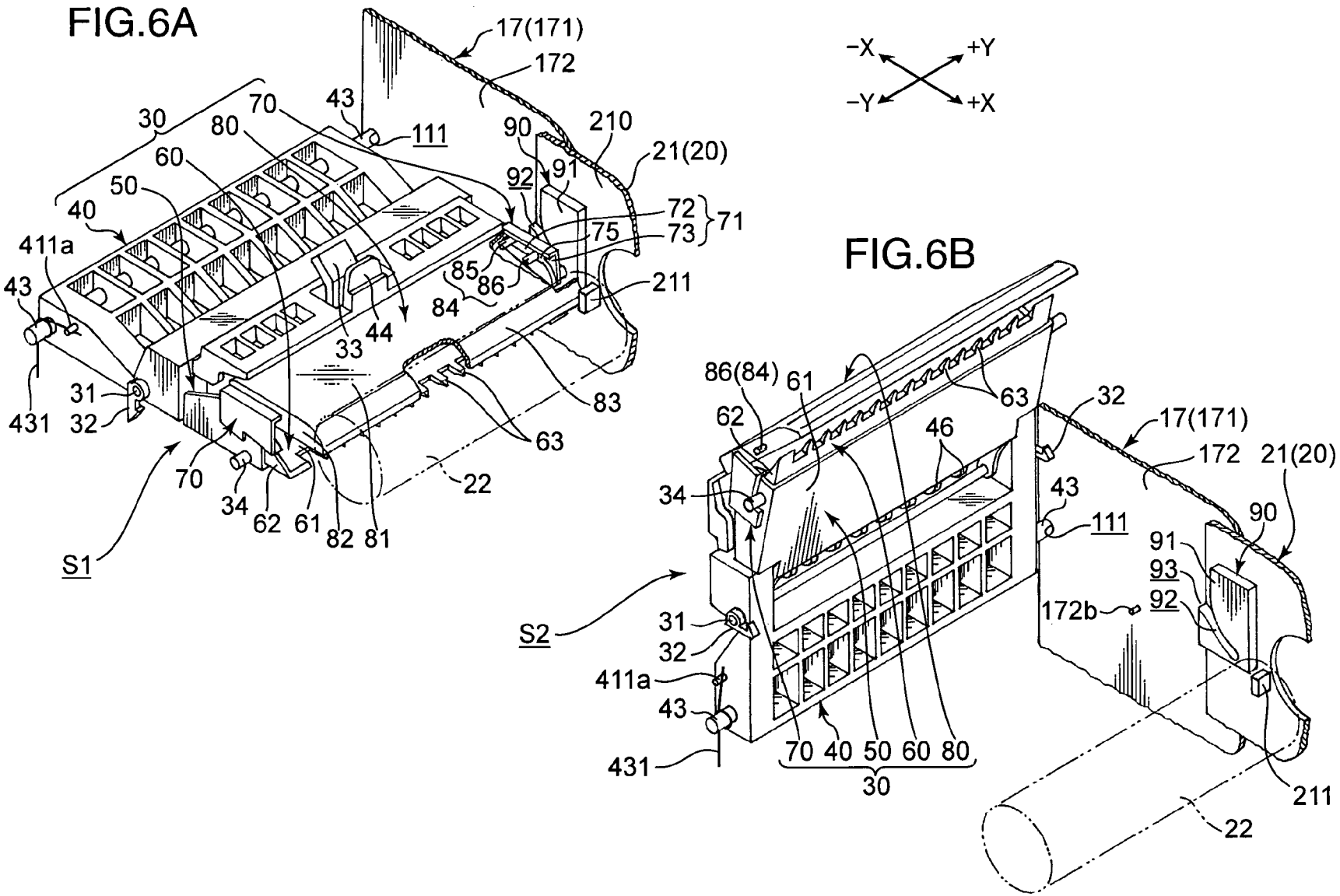

FIG. 5 is an exploded perspective view showing one embodiment of the cover unit 30. FIGS. 6A and 6B are assembled perspective views showing the cover unit 30 shown in FIG. 5, wherein FIG. 6A shows a state where the cover unit 30 is set at a covering position S1 to cover a downstream side of the fixing device 20 and FIG. 6B shows a state where the cover unit 30 is set at an exposing position S2 to expose the downstream side of the fixing device 20. In FIGS. 5 to 6A, 6B, X-X directions and Y-Y directions are referred to as transverse directions and forward and backward directions, respectively, wherein −X direction is direction is leftward direction, +X direction rightward direction, −Y direction forward direction and +Y direction backward direction.

The cover unit 30 is provided with a cover main body 40 rotatably mounted between the L-shaped frame elements 172 of the sheet conveyance unit 17 opposed to each other, a supporting plate 50 rotatably supported on the cover main body 40, a separating member 60 secured to the supporting plate 50, a pair of front and rear cover-unit side guiding members 70 fixed to the supporting plate 50, and a covering member 80 mounted on the guiding members 70 in such a manner that the position thereof can be changed. A pair of front and rear fixing-device side guiding members 90 are provided on side walls 210 of the fixing-device main body 21 opposed to each other. These guiding members 90 are for guiding the attachment and detachment of the cover unit 30 to and from the fixing device 20.

The cover main body 40 and the supporting plate 50 are members serving as a basis of the cover unit 30, and the separating member 60, the cover-unit side guiding members 70, the covering member 80 and various components of the cover unit 30 are mounted thereon.

The separating member 60 is for separating the sheet P trying to wind around the outer circumferential surface of the heating roller 22 by bringing the leading edge thereof into contact with the outer circumferential surface of the heating roller 22. The covering member 80 is for covering the leading edge of the separating member 60 with the sheet conveyance unit 17 withdrawn forward from the apparatus main body 11. The cover-unit guiding members 70 are for causing the covering member 80 to shift between a covering position and a retracted position with the cover unit 30 set at a mounted position and withdrawn from the mounted position. The fixing-device guiding members 90 are for causing the cover unit 30 to shift between the exposing position S2 and the covering position S1 when the cover unit 30 is withdrawn from the apparatus main body 11 and is pushed into the apparatus main body 11.

Hereinafter, the respective members of the cover unit 30 are described in detail. First, the cover main body 40 is comprised of a base frame 41 long in forward and backward directions and having a length slightly shorter than spacing between the inner surfaces of the pair of L-shaped frame elements 172 of the sheet conveyance unit 17, and a projecting frame 42 projecting to the right from the right edge of the base frame 41. The base frame 41 includes a pair of front and rear frame elements 411, a left frame element 412 bridging the left ends of the front and rear frame elements 411, a right frame element 413 bridging the right ends of the front and rear frame elements 411, a lengthwise crossing member 414 extending between substantially transverse middle positions of the front and rear frame elements 411, and a plurality of transverse crossing members 415 extending members 415 extending between the left and right frame elements 412, 413 via the lengthwise crossing member 414. The base frame 41 is formed to be lightweight while having a specified strength.

The base frame 41 is provided with a first shaft 43 penetrating the pair of front and rear frame elements 411 and the respective transverse crossing members 415 at a position to the left of the lengthwise crossing member 414. On the other hand, a fitting hole 172*a* into which the first shaft 43 is fitted is formed in each of the pair of L-shaped frame elements 172 of the frame 171 of the sheet conveyance unit 17. The cover main body 40 is so mounted in the apparatus main body 11 as to be rotatable about the first shaft 43 by having the ends of the first shaft 43 fitted into the fitting holes 172*a*.

Coil springs 431 (first biasing member) are fitted on the first shaft 43. One end of each coil spring 431 is resiliently deformably engaged with a projecting piece 411*a* projecting outward from the corresponding front or rear frame element 411, and the other end thereof is resiliently deformably engaged at a specified position of the corresponding L-shaped frame element 172. Thus, the base frame 41 receives biasing forces to turn in counterclockwise direction about the first shaft 43 from the coil springs 431.

The right frame element 413 extends between the upper end positions of the right ends of the pair of front and rear frame elements 411. A base-side coupling hole 416 into which a second shaft 31 to be described later is inserted is formed at a right bottom end of each of the front and rear frame elements 411.

Further, a plurality of hanging pieces 418 (see FIGS. 7 to 10) in the form of comb teeth hang down from the right frame element 413 between the pair of front and rear frame elements 411. A plurality of conveyance rollers 46 are rotatably supported on a roller shaft 417 penetrating these hanging pieces 418. With the cover unit 30 accommodated in the apparatus main body 11, a sheet coming out of the fixing section 14 is discharged toward the discharge tray 14 (see FIG. 2) while being guided by these conveyance rollers 46 and sliding on the lower surface of the base frame 41.

The projecting frame 42 projects to the right from the upper edge of the right frame element 413 of the base frame 41. Such a projecting frame 42 is comprised of a left frame element 421 long in forward and backward directions and projecting obliquely upward to the right from the right frame element 413 of the base frame 41, a right frame element 422 arranged in parallel with the left frame element 421 at a position slightly to the right of the left frame element 421, and a plurality of crossing members 423 extending between the left frame element 421 and the right frame element 422.

A cover-main-body side operating piece 44 projects upward at a lengthwise middle position of the right frame element 422 of the projecting frame 42. A mount opening 45 into which a rotating piece 33 to be described later is mounted is formed between the crossing members 423 at positions corresponding to this operating piece 44.

The supporting plate 50 is for supporting the separating member 60 and provided with a supporting-plate main body 51 having a rectangular shape long in forward and backward directions in plan view, a pair of front and rear side plates 52 formed by bending up the opposite front and rear portions of the supporting-plate main body 51, and a pair of front and rear brackets 53 projecting obliquely upward to the left from the left edge of the supporting-plate main body 51.

The length (dimension in forward and backward directions) of the supporting-plate main body 51 is set to be equal to that of the cover main body 40 and the transverse dimension thereof is set to be slightly shorter than that of the cover main body 40. The vertical dimension of the side plates 52 is set to be substantially equal to that of the base frame 41. An upper part of each side plate 52 is cut out at a right position to form a notch portion 521 used to mount the corresponding cover-unit side guiding member 70.

A spacing between the outer surfaces of both brackets 53 is set to be slightly shorter than spacing between the inner surfaces of the front and rear frame elements 411 of the base frame 41, whereby the respective brackets 53 are fitted between the front and rear frame elements 411 right below the right frame element 413. Supporting-plate side coupling holes 531 that are opposed to each other in forward and backward directions are formed at the leading sides of such brackets 53.

By inserting the second shaft 31 through the base-side coupling holes 416 and the supporting-plate side coupling holes 531 with the pair of brackets 53 fitted between the pair of front and rear frame elements 411 of the base frame 41, the cover main body 40 and the supporting plate 50 can be so coupled as to be rotatable relative to each other about the second shaft 31.

Locking levers (locking portion) 32 are fixed to the respective ends of the second shaft 31. The locking levers 32 are for holding the cover unit 30 accommodated in the apparatus main body 11, and hooks (engaging portion) 321 each having an open right side are formed at the bottom ends of the locking levers 32. On the other hand, locking projections 172*b* project from on the L-shaped frame elements 172 of the frame 171 of the sheet conveyance unit 17 at positions corresponding to the hooks 321. By engaging the locking levers 32 with the locking projections 172*b* with the cover unit 30 accommodated in the apparatus main body 11, the cover unit 30 can be held accommodated in the apparatus main body 11.

The rotating piece 33 is fixed at a middle position of the second shaft 31. This rotating piece 33 is so dimensioned as to project upward through the mount opening 45 of the projecting frame 42 of the cover main body 40 to face the cover-main-body side operating piece 44 with the second shaft 31 inserted through the base-side coupling holes 416 of the base frame 41. A coil spring (second biasing member) 34 is disposed between the rotating piece 33 and the cover-main-body side operating piece 44. One embodiment of a "locking member" according to the present invention is constructed by the second shaft 31, the locking levers (locking portions) 32 and the rotating piece (operating portion) 33.

With the hooks 321 of the locking levers 32 engaged with the locking projections 172*b* of the frame 171 of the sheet conveyance unit 17, the base frame 41 of the cover main body 40 receives biasing forces from the coil springs 431 to turn in counterclockwise direction about the first shaft 43. Thus, the hooks 321 of the locking levers 32 are pressed into contact with the locking projections 172*b* of the L-shaped frame element 172, whereby the posture of the cover main body 40 can be stabilized.

A user grips the rotating piece 33 and the cover-main-body operating piece 44 with fingers in this state, whereby the rotating piece 33 integrally rotates in clockwise direction about the second shaft 31 against the biasing force of the coil spring 34. The resulting clockwise rotation of the locking levers 34 disengages the hooks 321 from the locking projections 172*b*. 172*b*. Accordingly, the user can easily pull out the cover unit 30 from the covering position S1 while being assisted by the biasing forces of the coil springs 431 by pulling the rotating piece 33 and the cover-main-body side operating piece 44 upward while gripping them.

Conversely, upon setting the cover unit 30 at the covering position S1, the cover-main-body side operating piece 44 may be pressed downward without gripping the rotating piece 33 and the cover-main-body side operating piece 44. By doing so, slanted surfaces 322 formed at bottom parts of the hooks 321 of the locking levers 32 come into sliding contact with the locking projections 172*b*, and the hooks 321 are engaged with the locking projections 172*b* by the counterclockwise rotations of the locking levers 32 after the clockwise rotations thereof against the biasing force of the coil spring 34. Thus, the cover unit 30 is locked in its state accommodated in the sheet conveyance unit 17.

In such a supporting plate 50, third shafts 54 project outward at positions of the respective side plates 52 facing each other at right ends. These third shafts 54 are guided by the fixing-device side guiding members 90. By this guiding, the state of the cover unit 30 can be smoothly changed (changes in the state between the one where the cover unit 30 is accommodated in the apparatus main body 11, the one where the cover unit 30 is withdrawn from the apparatus main body 11 and the one where the the one where the cover unit 30 is accommodated into the apparatus main body 11).

Further, a leaf spring 55 is fixed to each side plate 52 at a position to the left of the notch portion 521 by means of screws or caulking. These leaf springs 55 are for biasing the covering member 80 mounted on the supporting plate 50 to the right via the cover-unit side guiding members 70, and project in a curved manner to the right from their fixed positions. Such leaf springs 55 press the covering member 80 to the right through elastic deformations resulting from the mounting of the covering member 80 on the supporting plate 50 via the cover-unit side guiding members 70.

The separating member 60 is for separating the sheet wound around the outer circumferential surface of the heating roller 22 while being fixed to the supporting plate 50. The separating member 60 is comprised of a separating-member main body 61 having a rectangular shape in plan view and a pair of front and rear bent plates 62 bent up at the respective front and rear edges of this separating-member main body 61.

The width of the separating-member main body 61 in forward and backward directions is set to be slightly shorter than the spacing between the inner surfaces of the pair of side plates 52 of the supporting plate 50, whereas the transverse dimension thereof is set to be longer than that of the supporting-plate main body 51 by a specified amount. Thus, the right end of the right end of the separating-member main body 61 projects outward from the supporting-plate main body 51 with the separating-member main body 61 fixed to the supporting-plate main body 51 by screws or another means.

A plurality of separating claws 63 each having a tip portion tapered to have an acute end are provided at the right end of such a separating-member main body 61 while being distributed over the entire length. These separating claws 63 can separate the sheet wound around the outer circumferential surface of the rotating heating roller 22 by being brought into contact with the outer circumferential surface of the rotating heating roller 22.

The cover-unit side guiding members 70 are for changing the position of the covering member 80 as the state of the cover unit 30 is changed, and fixed to the notch portions 521 formed in the respective side plates 52 of the supporting-plate main body 51 by screws or another means. These guiding members 70 have guiding grooves 71 formed on the surfaces thereof facing each other to guide the third shafts 54. Each guiding groove 71 includes a straight guiding portion 72 extending in transverse direction and having a vertical dimension slightly larger than the diameter of guidable pieces 84 of the covering member 80 to be described later, and a wider guiding portion 73 formed at a right end position of the straight guiding portion 72 and having a groove width gradually increasing toward the right.

The upper wall of the wider guide portion 73 is continuous with the upper wall of the straight guiding portion 72 and straight in transverse direction, whereas the lower wall thereof forms an arcuate wall surface 74 advancing downward. Further, the straight guiding portion 72 is set to be deeper than the wider guiding portion 73, thereby forming a stepped portion 75 between the straight guiding portion 72 and the wider guiding portion 73.

The covering member 80 is for covering the outer circumferential surface of the heating roller 22 at the left side when the cover unit 30 is accommodated at a specified accommodated position in the apparatus main body 11 and covering the separating claws 63 when it is at a retracted position, and has a substantially identical planar shape as the separating member 60. Such a covering member 80 is comprised of a covering-member main body 81 in the form of a flat plate, a pair of front and rear side plates 82 extending downward from the respective front and rear edges of the covering-member main body 81, and an arcuate right plate 83 bridging the right ends of the pair of side plates 82 and continuous with the covering-member main body 81. The arcuate right plate 83 has a convex shape projecting outward in side view.

The side plates 82 of such a covering member 80 are provided with the guidable pieces 84 projecting in opposite directions. The guidable pieces 84 include a first guidable piece piece 85 provided at the left end of the side plate 82, and a second guidable piece 86 provided substantially at a transverse middle position of the side plate 82. The first guidable pieces 85 are exposed parts of a shaft 851 mounted between and through the pair of side plates 82. The projecting distance of the first guidable pieces 85 is set to be slightly longer than that of the second guidable pieces 86 in conformity with the groove depth of the straight guiding portions 72. The projecting distance of the second guidable pieces 86 is so set as to conform to the groove depth of the wider guiding portion 73.

The covering member 80 is mounted between the pair of cover-unit side guiding members 70 against biasing forces of the pair of leaf springs 55 by fitting these first and second guidable pieces 85, 86 into the straight guiding portions 72 of the guiding grooves 71. Accordingly, the covering member 80 is pressed to the right by the biasing forces of the leaf springs 55 while being mounted between the straight guiding portions 72 of the cover-unit side guiding members 70.

On the other hand, stoppers 211 project at positions of the side walls 210 of the fixing-device main body 21 corresponding to the left side of the heating roller 22. With the cover unit 30 accommodated at the specified accommodated position in the apparatus main body 11, the arcuate right plate 83 of the covering member 80 interferes with the stoppers 211 as shown in FIG. 6A, whereby the covering member 80 is pushed to the left against the the left against the biasing forces of the leaf springs 55. On the contrary, with the cover unit 30 withdrawn from the specified accommodated position in the apparatus main body 11, the covering member 80 is pushed to the right by the biasing forces of the leaf springs 55 and the first and second guidable pieces 85, 86 project to the right while being guided by the guiding grooves 71.

In this embodiment, torsion coil springs 87 are fitted on the shaft 851, and the covering member 80 is biased in clockwise direction about the first guidable pieces 85 by biasing forces of the torsion coil springs 87. Accordingly, when the cover unit 30 is withdrawn from the accommodated position in the apparatus main body 11, the covering member 80 is brought out of contact with the stoppers 211 and pushed to the right by the biasing forces of the leaf springs 55. Then, the second guidable pieces 86 come out of the straight guiding portions 72 of the guiding grooves 71, and the first guidable pieces 85 come to stop at the stepped portions 75 of the guiding grooves 71. This causes the covering member 80 to rotate in clockwise direction about the first guidable pieces 85 by the biasing forces of the torsion coil springs 87, thereby setting the covering member 80 at the covering position to cover the separating claws 63 of the separating member 60 as shown in FIG. 6B.

The fixing-device guiding members 90 are for guiding the the position change of the cover unit 30 between a bent position (exposing position S2) and the covering position S1 when the cover unit 30 is withdrawn from the apparatus main body 11 and pushed into the apparatus main body 11, and positioning the supporting plate 50 with the cover unit 30 accommodated in the apparatus main body 11. A pair of guiding members 90 are so provided on the pair of side walls 210 of the fixing-device main body 21 as to face each other.

Each of such guiding members 90 is formed by a plate-like body 91 fixed to the corresponding side wall 210 and having a specified thickness, and an arcuate guiding groove 92 into which the corresponding third shaft 54 is fittable is formed to incline downward toward the right from the left edge of the plate-like body 91. The width of this arcuate guiding groove 92 is set to be slightly larger than the diameter of the third shaft 54, and a widened portion 93 whose width is set to gradually increase toward the left is provided at the entrance of the arcuate guiding groove 92, so that the third shaft 54 can be easily fitted into the arcuate guiding groove 92.

With the third shafts 54 fitted to the backs of the arcuate guiding grooves 92, the cover unit 30 is set at the covering position S1 as shown in FIG. 6A. On the other hand, the rotating piece 33 and the cover-main-body operating piece 44 are gripped and pulled upward, whereby the third shafts 54 come out of the arcuate guiding grooves 92 while being guided by these guiding these guiding grooves 92, consequently setting the cover unit 30 at the exposing position S2 as shown in FIG. 6B.

Figure 7:
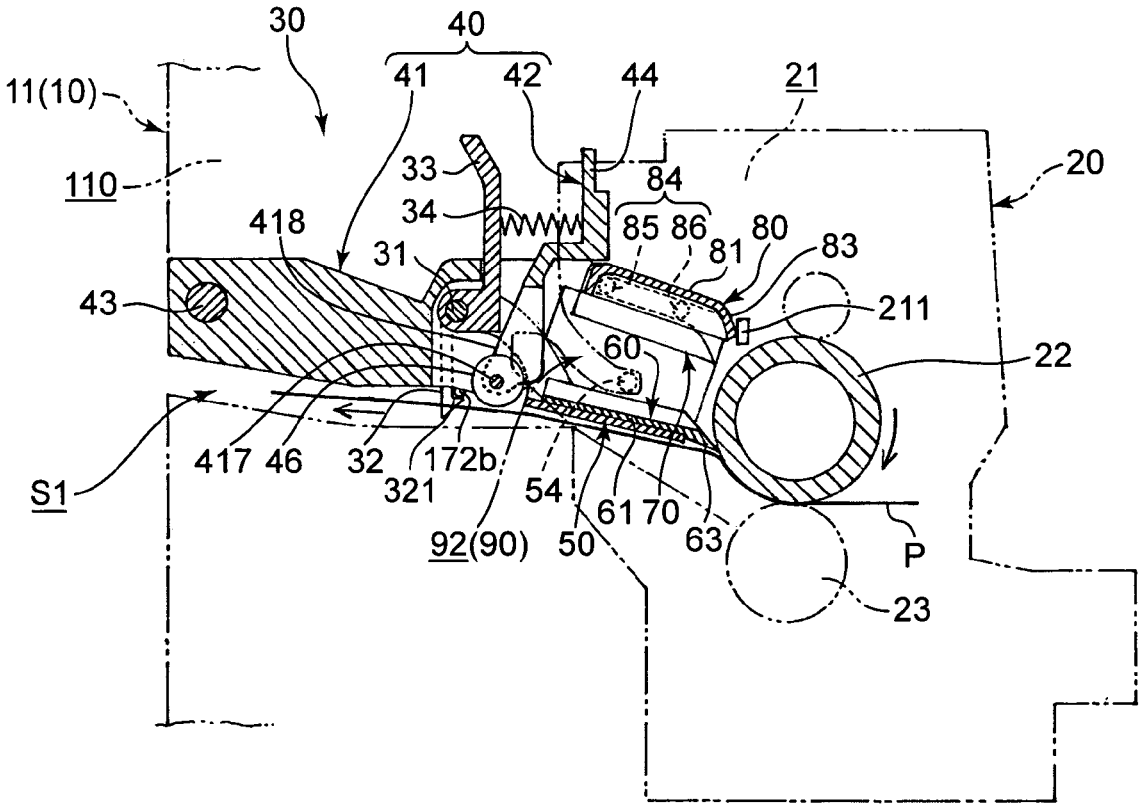
Figure 8:
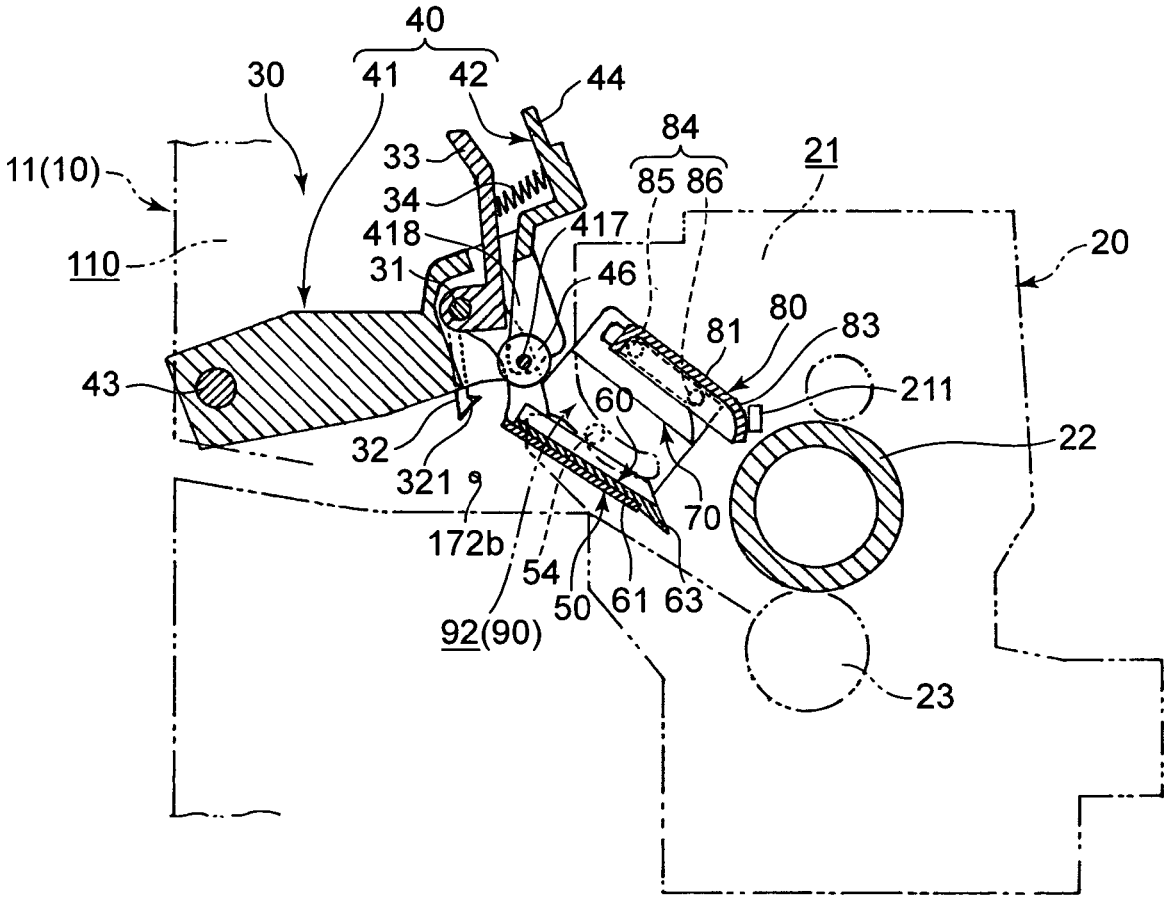
Figure 9:
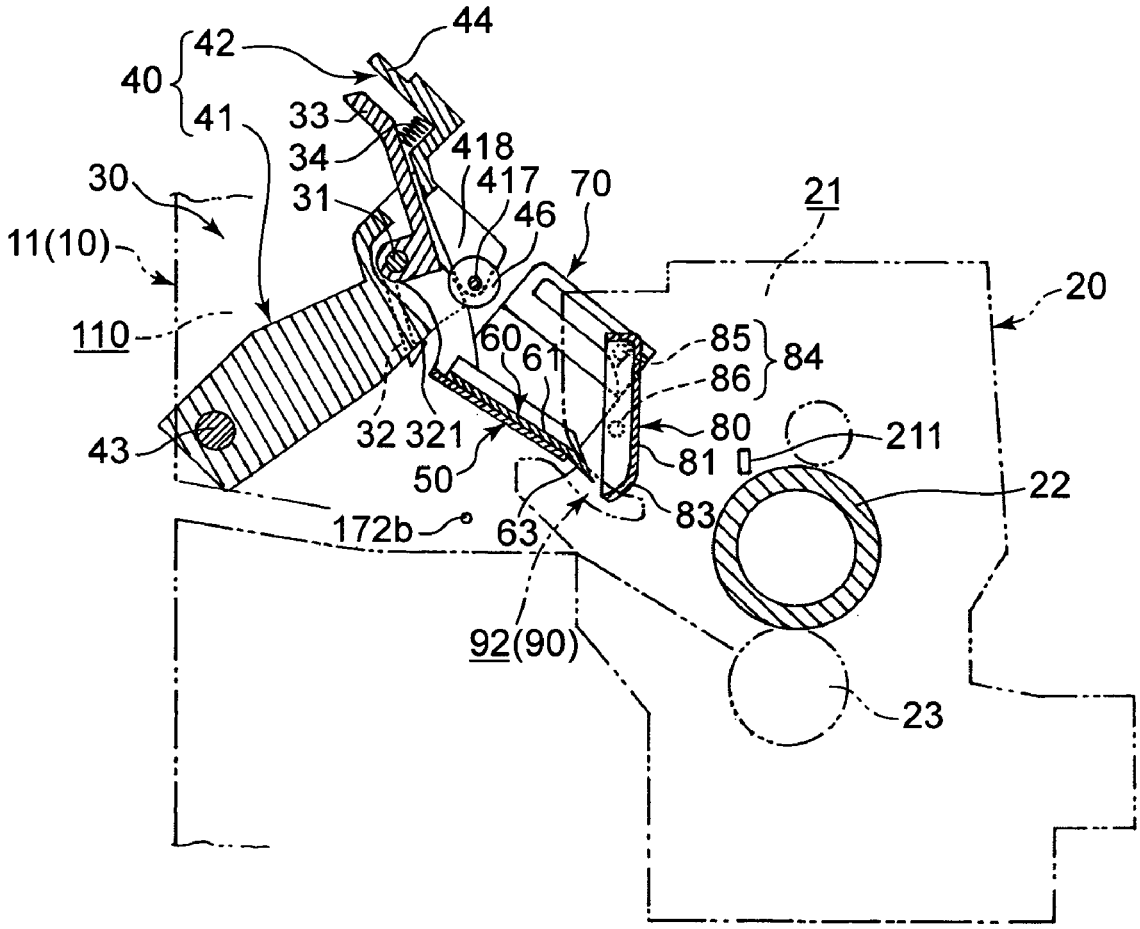
Figure 10:
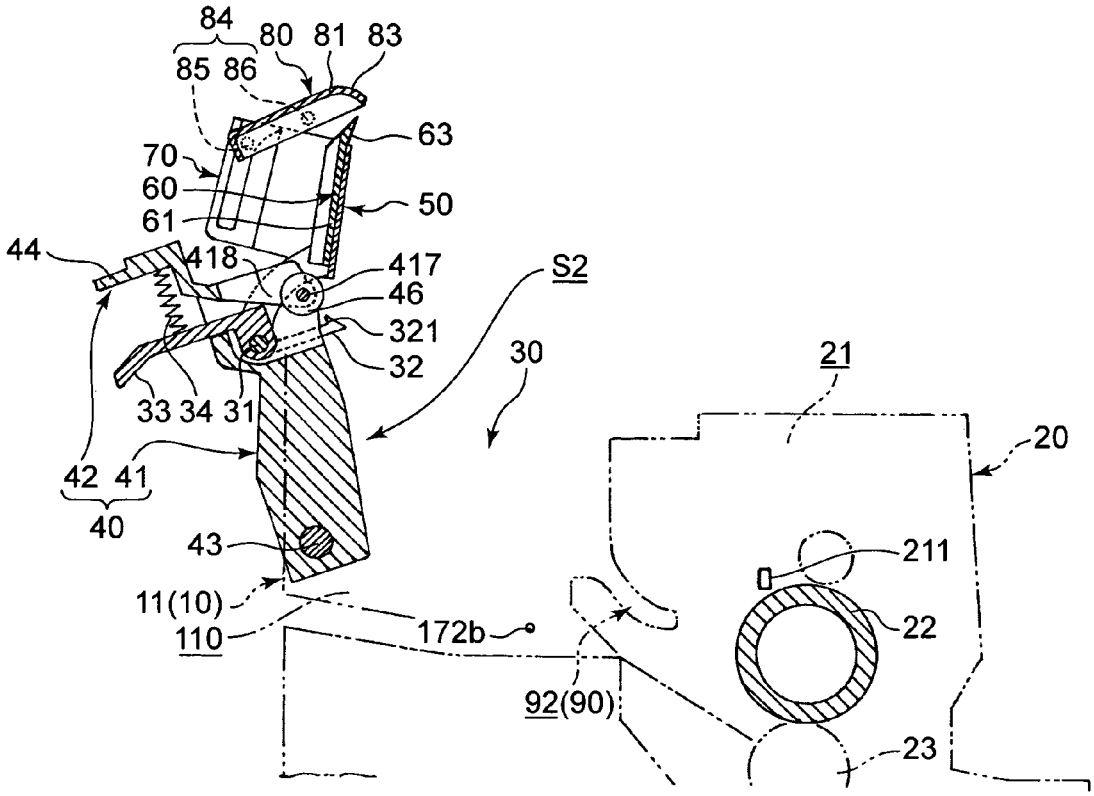

Hereafter, functions of the cover unit 30 thus constructed are described with reference to FIGS. 7 to 10. FIGS. 7 to 10 are diagrams showing the functions of the cover unit 30, wherein FIG. 7 shows the state where the cover unit 30 is extended to be set at the covering posture S1 to cover the downstream side of the fixing device 20, FIG. 8 shows the state where the withdrawal of the cover unit 30 from the apparatus main body 11 is started, FIG. 9 shows the state where the cover unit 30 is at the bent position immediately after the third shafts 54 come out of the arcuate guiding grooves 92, and FIG. 10 shows the state where the cover unit 30 is completely withdrawn to be set at the exposing position S2 to expose the downstream side of the fixing device 20.

First, as shown in FIG. 7, the cover main body 40 and the supporting plate 50 extend straight with the cover unit 30 set at the covering position S1. This causes the right end of the covering member 80 to be stopped by the stoppers 211 provided on the side walls 210 of the fixing-device main body 21, and the third shafts 54 are fitted to the left ends of the straight guiding portions 72 with the covering member 80 held in parallel with the separating member 60 (i.e. with the covering member 80 set at the retracted position). Further, the tips of the separating claws 63 of the separating member 60 are in contact contact with the outer circumferential surface of the heating roller 22.

In this state, the hooks 321 of the locking levers 32 provided on the cover main body 40 are engaged with the locking projections 172*b* projecting from the L-shaped frame elements 172 of the apparatus main body 11. Thus, the cover unit 30 can be securely kept at the covering position S1. Accordingly, if the cover unit 30 is at this position S1 and the sheet conveyance unit 17 is pushed in the apparatus main body 11, a sheet P wound round the outer circumferential surface of the heating roller 22 is separated by the separating claws 63 upon coming out of the fixing device 20. In addition, the lower surface of the cover unit 30 functions as a guiding surface for the sheet P, which passes along the lower surface of the cover unit 30 and is discharged onto the discharge tray 164 via the pair of discharge rollers 163 (see FIG. 1).

Subsequently, upon withdrawing the cover unit 30 from the specified mount position in the apparatus main body 11 for the removal of a jammed sheet or a maintenance operation, the rotating piece 33 and the cover-main-body operating piece 44 are gripped with the fingers in the state shown in FIG. 7. This causes the rotating piece 33 to rotate in clockwise direction about the second shaft 31. The locking levers 32 integrally coupled to the rotating piece 33 via the second shaft 31 also rotate in clockwise direction about the second shaft 31 to disengage the hooks 321 disengage the hooks 321 from the locking projections 172*b*. As a result, the cover unit 30 can shift from the covering position S1 to the bent position.

By gripping the operating piece 33 and the cover-main-body operating piece 44 and pulling them upward in this state, the cover main body 40 rotates in counterclockwise direction about the first shaft 43 as shown in FIG. 8. The supporting piece 50 rotates in clockwise direction about the second shaft 31 while the third shafts 54 are guided by the arcuate guiding grooves 92 of the fixing-device side guiding members 90 provided on the side walls 210 of the fixing-device main body 21. As a result, the cover unit 30 comes to be bent upward at its transverse center.

At this time, since the covering member 80 is pushed to the right by the biasing forces of the leaf springs 55 provided on the supporting plate 50, the covering member 80 moves to the right relative to the separating member 60 while the first and second guidable pieces 85, 86 provided on the covering member 80 are guided by the guiding grooves 71 of the cover-unit side guiding members 70 provided on the supporting plate 50.

Then, when the third shafts 54 of the supporting plate 50 come out of the arcuate guiding grooves 92 of the fixing-device side guiding members 90 as shown in FIG. 9, the second guidable pieces 86 come out of the guiding grooves 71 to the right. Further, the first guidable pieces 85 are located at the rightmost rightmost positions of the straight guiding portions 72 of the guiding grooves 71 and stopped at the stepped portions 75. In this state, the covering member 80 is rotated in clockwise direction about the first guidable pieces 85 by the biasing forces of the torsion coil springs 87, whereby the covering member 80 is shifted from the retracted position where it is parallel to the separating member 60 to the covering position where it covers the separating claws 63 of the separating member 60.

If a user continues to rotate the cover main body 40 in counterclockwise direction about the first shaft 43 to the end while continuously gripping the rotating piece 33 and the cover-main-body operating piece 44 and then rotates the supporting plate 50 in clockwise direction about the second shaft 31, the cover unit 30 stands upright on the first shaft 43 to be set at the exposing position S2 as shown in FIG. 10. In this state as well, the tips of the separating claws 63 are covered by the arcuate right plate 83 of the covering member 80. Therefore, even if hand is inserted into a space defined at the left side of the fixing device 20 for the maintenance operation, such an inconvenience as to damage the separating claws 63 by a hand-held tool or the like can be securely prevented.

In this embodiment, the cover-body locking construction according to the present invention is applied to the cover unit 30 described as above, and is for securely returning the cover unit unit 30 again to the initial covering position S1 after the sheet conveyance unit 17 is withdrawn from the apparatus main body 11 and the cover unit 30 is shifted to the exposing position S2.

Specifically, there are cases where the sheet conveyance unit 17 is pushed into the apparatus main body 11 without the hooks 321 of the locking levers 32 being securely engaged with the locking projections 172*b* of the frame 171 for a certain reason, i.e. with the cover unit 30 left locked halfway upon returning the cover unit 30 to the covering position S1 after a specified maintenance operation is carried out with the frame 171 of the sheet conveyance unit 17 once withdrawn and the cover unit 30 is shifted from the covering position S1 to the exposing position S2. If the cover unit 30 is accommodated into the apparatus main body 11 while being locked halfway, the hooks 321 are disengaged from the locking projections 172*b* by slight vibration or passage of the sheet P during the image forming operation, with the result that the cover unit 30 cannot be locked at the covering position S1 any longer.

Unless the cover unit 30 is locked at the covering position S1, the posture of the cover unit 30 becomes unstable. Thus, the sheet P coming out of the fixing device 20 after the image fixing operation cannot be securely guided by the lower surface of the cover unit 30, which causes problems such as likeliness to occur a sheet jam at this position. In this embodiment, a locking construction for preventing occurrences of such problems is applied.

Figure 11:
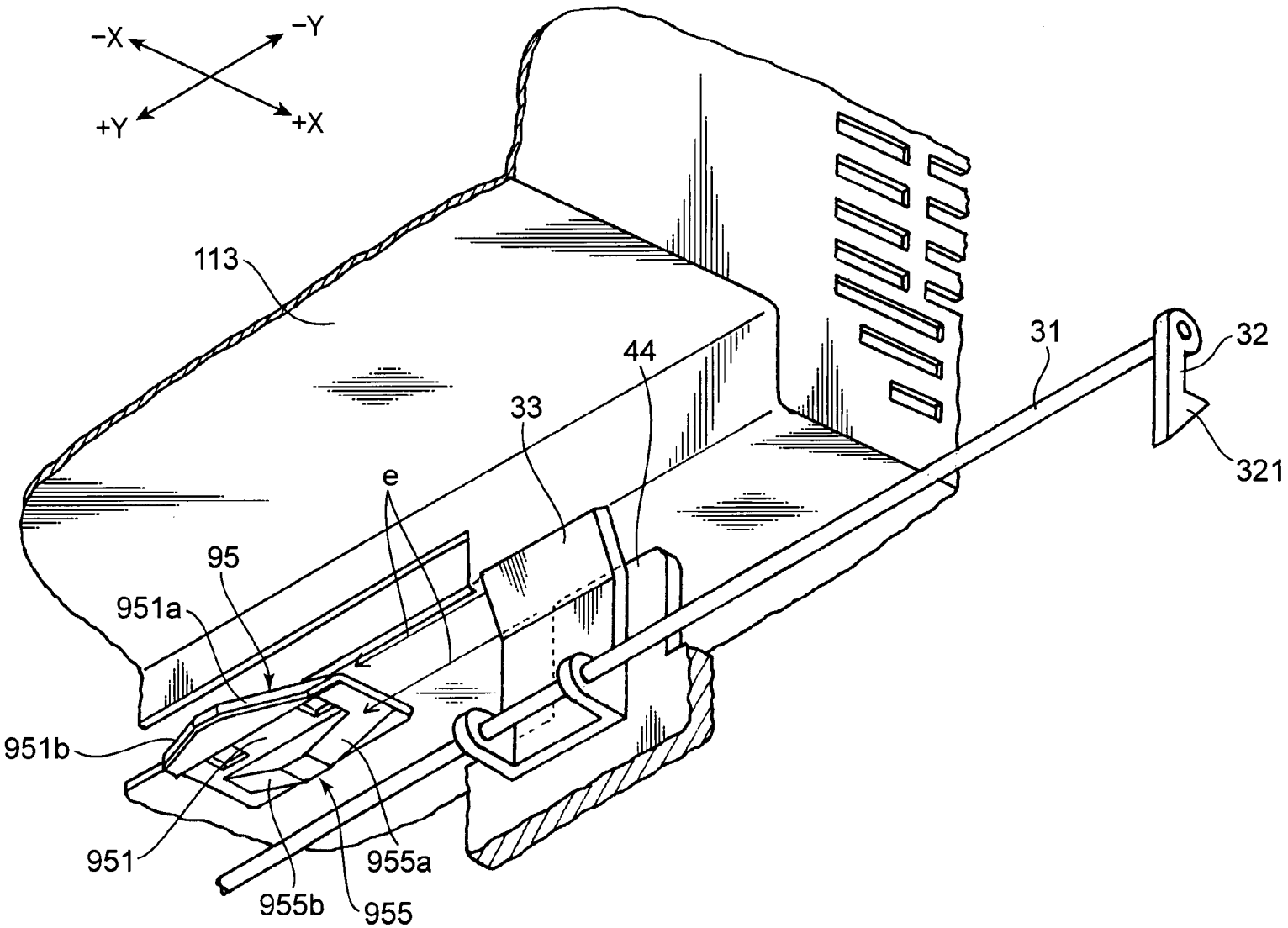
FIG. 11 is a perspective view showing a set state of a lock guiding member as a component of a cover-body locking construction.

FIG. 11 is a perspective view showing an installed state of a lock guiding member 95 as a component of the cover-body locking construction when the lock guiding member 95 fixed to a ceiling frame 113 right above the fixing device 20 is seen upon looking into the apparatus main body 11 obliquely from below with the sheet conveyance unit 17 withdrawn. FIG. 11 also shows the rotating piece 33 and the cover-main-body operating piece 44 so that their positions relative to the lock guiding member 95 can be seen. It should be noted that directions indicated by X and Y in FIG. 11 are similar to the case of FIG. 2 (X are transverse directions (−X: leftward direction, +X: rightward direction) and Y are forward and backward directions (−Y: forward direction, +Y: backward direction)).

As shown in FIG. 11, the lock guiding member 95 is so shaped as to securely engage the hooks 321 of the locking levers 32 with the locking projections 172*b* of the frame 171 by interfering with the cover unit 30 and the rotating piece 33 upon inserting the frame 171 into the apparatus main body 11 with the fixing device 20 covered by the cover unit 30. The lock guiding member 95 is provided at a middle position of the ceiling frame 113 with respect to forward and backward directions so as to correspond to the locking levers 32 when the cover unit 30 is withdrawn from the apparatus main body 11 and covers the covers the downstream side of the fixing device 20.

At which position the lock guiding member 95 is provided in the apparatus main body 11 can be easily understood from FIG. 4. Upon shifting the sheet conveyance unit 17 from the withdrawn position U2 to the accommodated position U1, the top of the rotating piece 33 and that of the cover-main-body operating piece 44, which is part of the cover main body 40, interfere with the lock guiding member 95 as indicated by arrows e in FIG. 11. By this interference, the cover main body 40 is lowered and the hooks 321 of the locking levers 32 are engaged with the locking projections 172*b* provided on the L-shaped frame elements 172 of the sheet conveyance unit 17. The lock guiding member 95 has the three-dimensional shape thereof set to realize the above lowering movement and engagement.

Figure 12A:
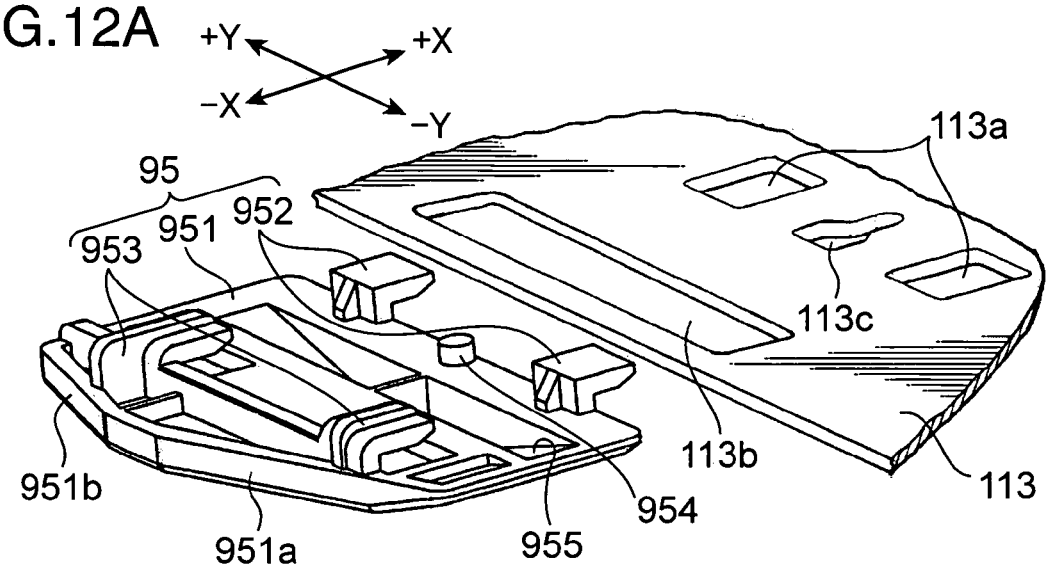
Figure 12B:
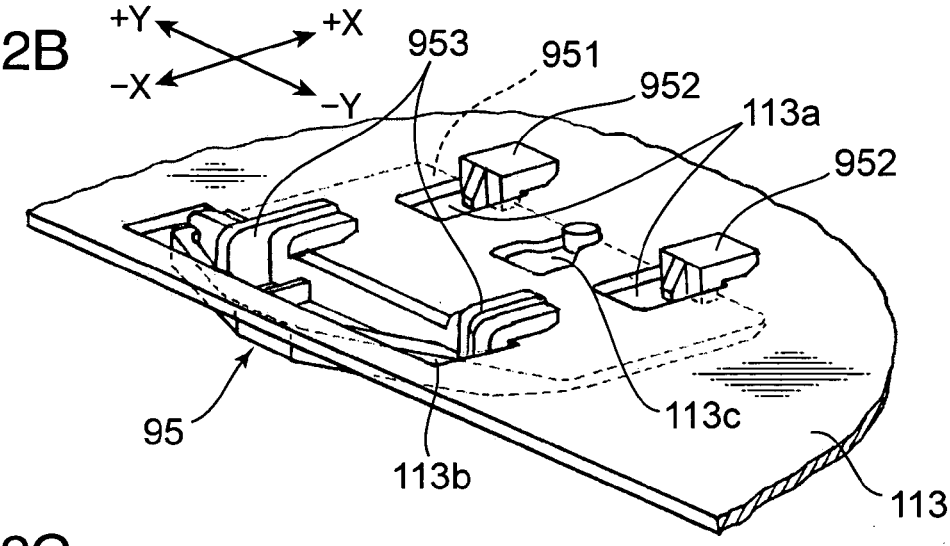
Figure 12C:
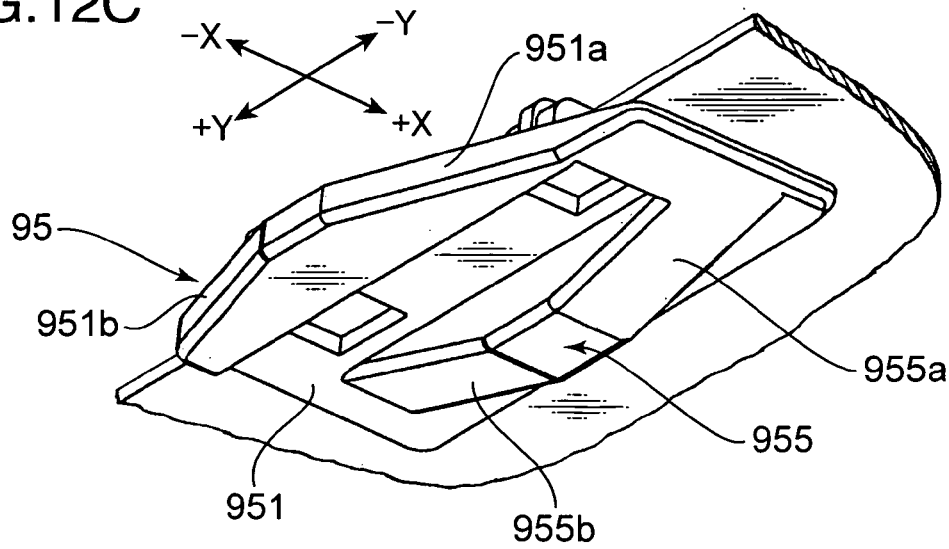

FIGS. 12A to 12C are perspective views showing one embodiment of the lock guiding member 95, wherein FIG. 12A shows a state immediately before the lock guiding member 95 is mounted on the ceiling frame 113 when viewed obliquely from above, FIG. 12B shows a state where the lock guiding member 95 is mounted on the ceiling frame 113 when viewed obliquely from above and FIG. 12C shows the state of FIG. 12B when viewed obliquely from below. It should be noted that directions indicated by X and Y in FIGS. 12A to 12C are similar to the case of FIG. 2 (X are transverse directions (−X: leftward direction, +X: rightward direction) and Y are forward and backward directions (−Y: forward direction, +Y: forward direction, +Y: backward direction)).

As shown in FIG. 12A, the lock guiding member 95 is comprised of a base plate 951 having a pentagonal shape like a baseball's home base in plan view (pentagonal shape having a pair of lateral sides extending from the opposite ends of a bottom side in the same direction at right angles to the bottom side and having the same length, and a pair of oblique sides extending from the leading ends of the respective lateral sides at the same obtuse angles in oblique directions toward each other), a pair of right locking claws 952 spaced apart in forward and backward directions and standing at the right edge of the base plate 951, a pair of left locking claws 953 spaced apart in forward and backward directions and standing at positions to the left of the right locking claws 952, a cylindrical piece 954 standing between the pair of right locking claws 952 and a bulging portion 955 bulging out downward from the underside of the base plate 952 between the pair of right locking claws 952 and the pair of left locking claws 953 and elongated in forward and backward directions (see FIG. 12C).

The right locking claws 952, the left locking claws 953 and the cylindrical piece 954 are for mounting the lock guiding member 95 on the ceiling frame 113 through a one-touch operation. The right and left locking claws 952, 953 are hooked by having the upper ends thereof bent to the right, and these hooked portions are engaged with the ceiling frame 113.

On the other hand, the ceiling frame 113 is formed with a pair of right locking holes 113*a* spaced apart in forward and backward directions, a left locking hole 113*b* elongated in forward and backward directions, and an irregularly-shaped hole 113*c* at a position where the lock guiding member 95 is to be mounted, the holes 113*a*, 113*b* and 113*c* respectively corresponding to the pair of right locking claws 952, the pair of left locking claws 953 and the cylindrical shape 954.

In the state of FIG. 12A, the respective right locking claws 952 are fitted into the corresponding right locking holes 113*a* from below the ceiling frame 113, and the cylindrical piece 954 is fitted into the irregularly-shaped hole 113*c*. In this state, the base plate 951 is moved to the right to further fit the respective left locking claws 953 into the elongated left locking hole 113*b*, whereby the lock guiding member 95 is mounted on the ceiling frame 113 as shown in FIGS. 12B and 12C.

The base plate 951 is formed such that the front and rear edges thereof are parallel to each other and the right edge is at right angles to the front and rear edges. On the contrary, the left edge is formed by a pair of front and rear oblique edges (front oblique edge 951*a* and rear oblique edge 951*b*) extending obliquely to the right toward the front and back from an apex projected leftward not more than about ⅓ of the length of the front or read edge.

An extending direction of the bulging portion 955 is set set to be parallel to the right edge of the base plate 951 (i.e. parallel to the withdrawing direction of the sheet conveyance unit 17). The bulging portion 955 is, as shown in FIG. 12C, formed such that a middle part thereof with respect to forward and backward directions is located at a bottommost level and a front slant 955*a* (first slant) extends from this middle part obliquely upward toward the front while a rear slant 955*b* (second slant) extends from this middle part obliquely upward toward the back.

The position of the lock guiding member 95 including such a bulging portion 955 is set such that the top of the cover-main-body operating piece 44 of the cover unit 30 interferes with the front slant 955*a* of the bulging portion 955 upon pushing the sheet conveyance unit 17 once withdrawn from the apparatus main body 11 into the apparatus main body 11.

When the sheet conveyance unit 17 is pushed into the apparatus main body 11 with the cover unit 30 set at the covering position S1 (first inserting operation), the cover-main-body operating piece 44 interferes with the front slant 955*a* of the bulging portion 955 and is relatively pushed downward against the biasing forces of the coil springs 431 by this front slant 955*a*. Accordingly, if the hooks 321 of the locking levers 32 are, for example, locked halfway without being completely engaged with the locking projections 172*b* of the L-shaped frame elements 172, the hooks 321 are lowered to pass over the locking projections 172*b* over the locking projections 172*b* and are gradually lifted as the sheet conveyance unit 17 is pushed (second inserting operation) after the cover-main-body operating piece 44 reaches the rear slant 955*b*. Thus, the half-locked state of the hooks 321 and the locking projections 172*b* can be canceled.

Further, the position of the front oblique edge 951*a* formed at the left edge of the base plate 951 is so set as to interfere with the rotating piece 33 in synchronism with the downward movement of the cover unit 30 resulting from the interference of the cover-main-body operating piece 44 with the bulging portion 955 to rotate the rotating piece 33 in counterclockwise direction about the second shaft 31 upon pushing the sheet conveyance unit 17 into the apparatus main body 11.

Accordingly, as the sheet conveyance unit 17 is pushed into the apparatus main body 11, the cover unit 30 can be securely locked into the frame 171 set at the accommodated position U1 by the action of the bulging portion 955 and the front oblique edge 951*a* of the base plate 951 of the lock guiding member 95 even if the cover unit 30 supported on the frame 171 is locked halfway into the frame 171.

Figures 13A, 13B, 13C:
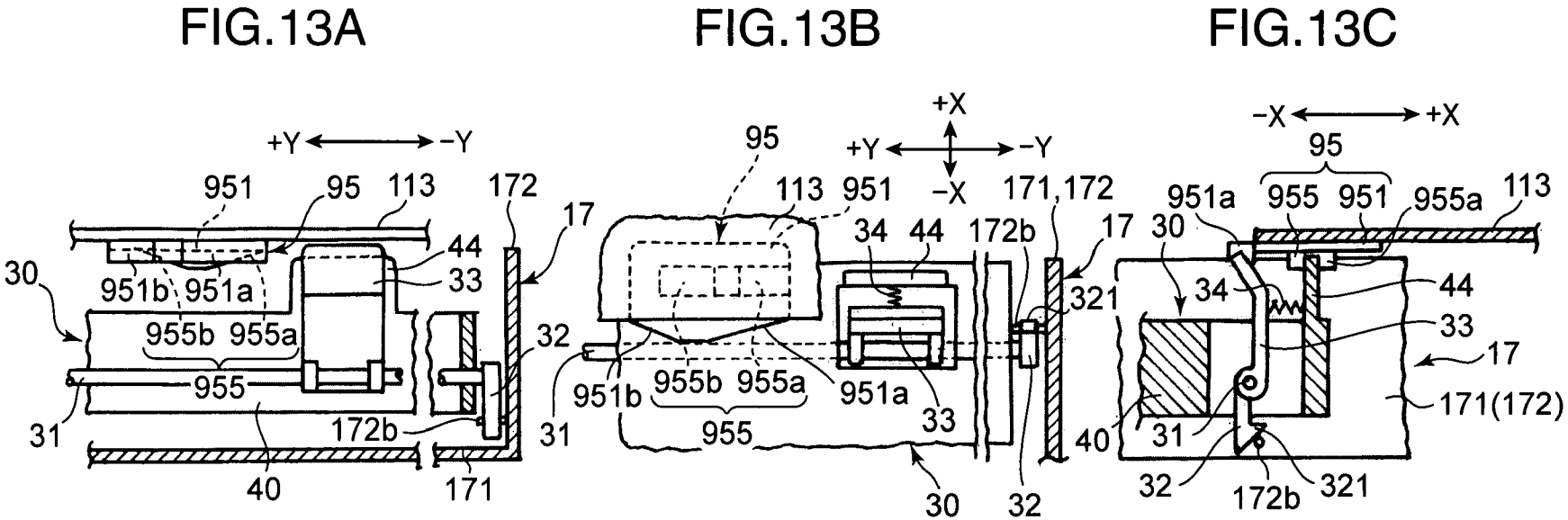
FIGS. 13A to 13C are diagrams showing the function of the cover-body locking construction, wherein a state of a rotating piece and a cover-main-body side operating piece approaching the lock guiding member is shown.
Figure 14A:
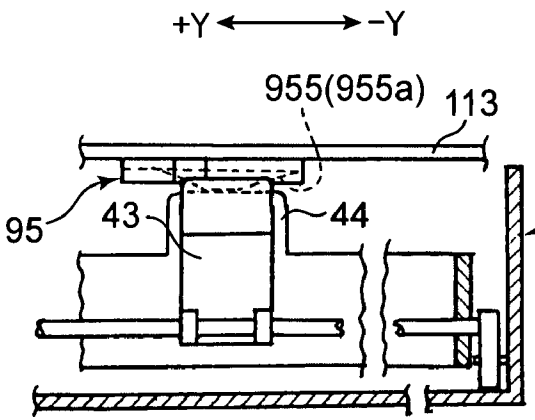
FIG. 14A to 14C are diagrams showing the function of the cover-body locking construction, wherein a state of the cover-side operating piece is lowered due to the interference with the lock guiding member is shown.
Figure 14B:
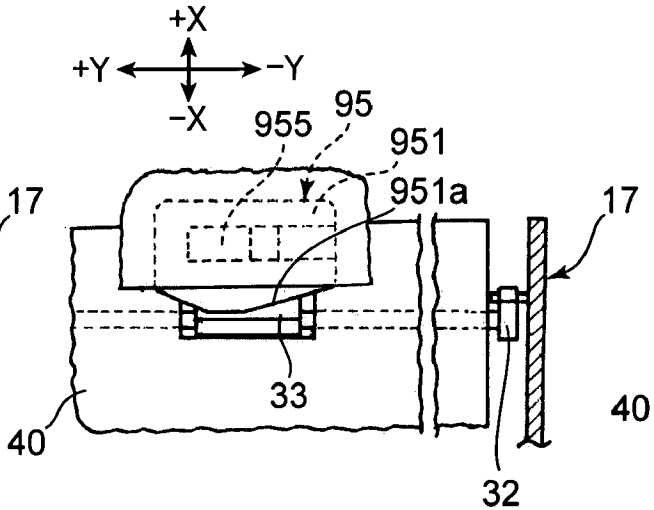
Figure 14C:
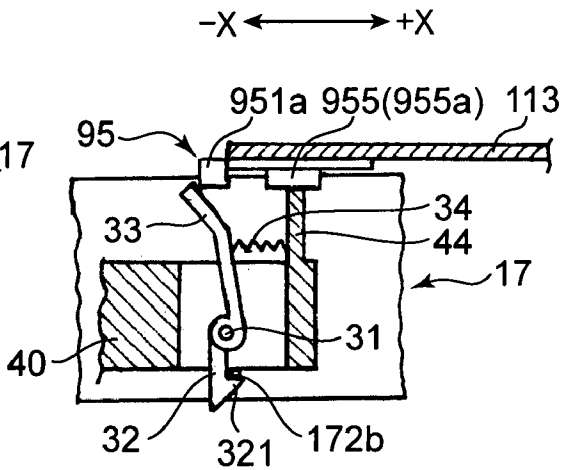

Functions of the cover-body locking construction according to the present invention are described below with reference to FIGS. 13 to 15 and, if necessary, also to other figures. FIGS. 13A to 13C are respectively a side view in section, a plan view in section and a front view showing a state where the rotating piece 33 and the cover-main-body operating piece 44 are approaching the lock guiding member 95. FIGS. 14A to 14C are respectively a side view in section, a plan view in section and a front view showing a state where the cover-main-body operating piece 44 is lowered by the interference thereof with the lock guiding member 95. FIGS. 15A to 15C are respectively a side view in section, a plan view in section and a front view showing a state where the rotating piece 33 and the cover-main-body operating piece 44 have passed the lock guiding member 95.

A case is presumed where the sheet conveyance unit 17 is pushed into the apparatus main body 11 despite the fact that the cover unit 30 has not yet completely returned from the exposing position S2 to the covering position S1 for a certain reason upon returning the cover unit 30 once withdrawn from the apparatus main body 11 into the apparatus main body 11 as shown in FIG. 4. In this case, the sheet conveyance unit 17 is pushed into the apparatus main body 11 without the hooks 321 of the locking levers 32 being engaged with the locking projections 172*b* provided on the L-shaped frame elements 172 of the sheet conveyance unit 17 as shown in FIG. 13C.

If the sheet conveyance unit 17 continues to be pushed in this state, the cover-main-body operating piece 44 of the cover main body 40 of the cover unit 30 first interferes with the the bulging portion 955 of the lock guiding member 95. The cover-main-body operating piece 44 is pushed downward by the front slant 955*a* of the bulging portion 955, whereby the cover main body 40 is pushed toward the back side of the apparatus main body 11 while being lowered. The lowering movement of the cover main body 40 continues until the hooks 321 of the locking levers 32 reach positions lower than the locking projections 172*b*.

Subsequently, the rotating piece 33 comes to interfere with the front oblique edge 951*a* of the base plate 951 of the lock guiding member 95 when the cover main body 40 is lowered to a certain degree. The rotating piece 33 is guided by the inclination of the front oblique edge 951*a*, thereby exerting a force in counterclockwise direction in FIG. 13C about the second shaft 31. Thus, the hooks 321 of the locking levers 32 are forcibly engaged with the locking projections 172*b* with the cover-main-body side operating piece 44 located at the bottommost position of the front oblique edge 951*a* of the lock guiding member 95 as shown in FIG. 14C.

Figures 15A, 15B, 15C:
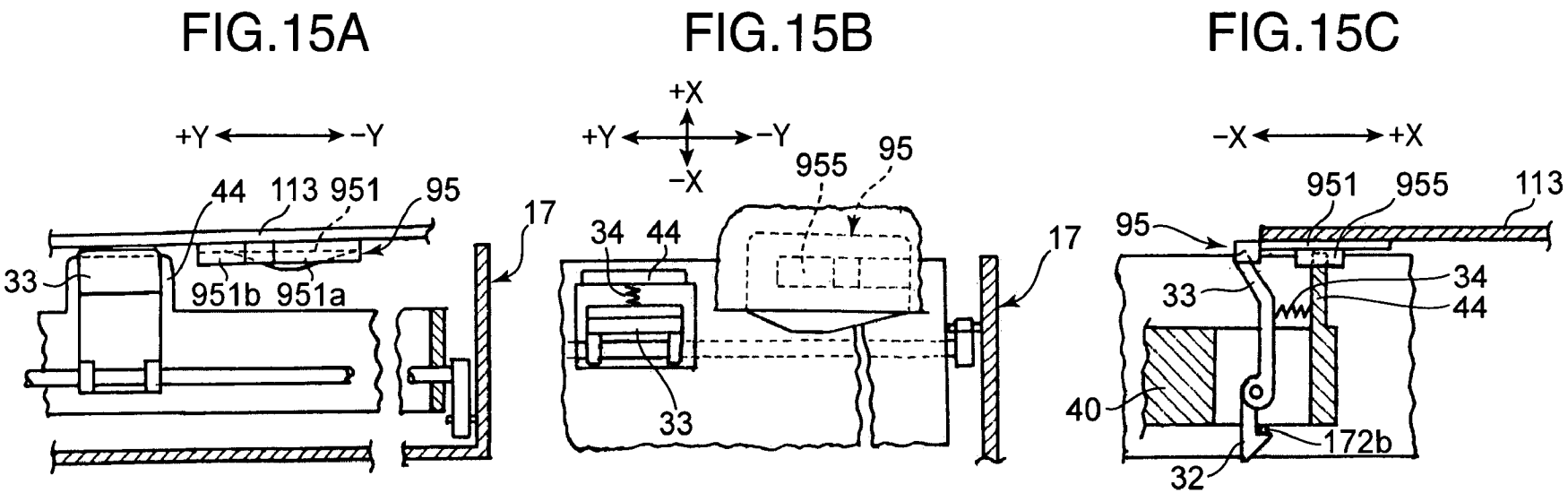
FIGS. 15A to 15C are diagrams showing the function of the cover-body locking construction, wherein a state of the rotating piece and the cover-main-body side operating piece having passed beyond the lock guiding member is shown.

If the sheet conveyance unit 17 further continues to be pushed into the apparatus main body 11, the rotating piece 33 and the cover-main-body operating piece 44 come to separate from the lock guiding member 95 as shown in FIGS. 15A to 15C. Thereafter, as shown in FIG. 15C, the locking levers 32 are held to be engaged with the locking projections 172*b* by the biasing force of the coil force of the coil spring 34.

Accordingly, even if the cover unit 30 is not completely locked in a certain situation upon returning the cover unit 30 set at the exposing position S2 to the covering position S1 after a maintenance operation is carried out with the sheet conveyance unit 17 withdrawn from the apparatus main body 11 and the cover unit 30 shifted from the covering position S1 to the exposing position S2, the cover unit 30 can be locked at the covering position S1 by the action of the lock guiding member 95 by pushing the sheet conveyance unit 17 into the apparatus main body 11. Therefore, an occurrence of an inconvenience such as sheet jam that occurs because the cover unit 30 is not locked at the covering position S1 can be securely prevented.

As described above in detail, the cover-body locking construction according to this embodiment is for locking the cover unit 30 at the covering position S1, the cover unit 30 being constructed to be shiftable between the covering position S1 to cover the downstream side of the fixing device 20 as a structure supported on the frame 171 insertable into and withdrawal from the specified apparatus main body 11 and the exposing position S2 to expose the fixing device 20 withdrawn from the apparatus main body 11 to the outside without covering it any longer. The cover unit 30 is provided with the locking member having the locking levers 32 for locking the cover unit 30 set at the covering position S1 30 set at the covering position S1 into the frame 171 and the rotating piece 33 for locking and unlocking the locking levers 32. Further, the apparatus main body 11 is provided with the lock guiding member 95 shaped to interlock the locking levers 32 with the frame 171 by the interference thereof with the cover unit 30 and the rotating piece 33 upon inserting the frame 171 into the apparatus main body 11 with the fixing device 20 covered by the cover unit 30.

With such a construction, a maintenance operation can be applied to the fixing device 20 or the fixing device 20 can be replaced by a new one by setting the cover unit 30 at the exposing position S2 with the frame 171 withdrawn from the apparatus main body 11. By shifting the cover unit 30 from the exposing position S2 to the covering position S1, the lock guiding member 95 causes the locking levers 32 to be forcibly interlocked with the frame 171 by coming to interfere with the cover unit 30 and the operating portion of the locking member when the frame 171 is pushed into the apparatus main body 11 with the fixing device 20 covered. Thus, even if the frame 171 is pushed into the apparatus main body 11 without the locking levers 32 being interlocked with the frame 171 due to the incomplete covering of the fixing device 20 by the cover unit 30, the locking levers 32 of the cover unit 30 can be securely interlocked with the frame 171 as the frame 171 is pushed into the apparatus main body 11.

By providing the apparatus main body 11 with such a lock guiding member 95, the locking member of the cover unit 30 never fails to be interlocked with the frame 171 if the frame 171 is pushed into the apparatus main body 11. Accordingly, an occurrence of such an inconvenience that the frame 171 is pushed into the apparatus main body 11 without the cover unit 30 being securely locked into the frame 171 and, hence, the cover unit 30 cannot securely fulfill its function as with the prior art can be securely prevented in this embodiment.

The cover unit 30 is so mounted on the frame 171 as to be shiftable between the covering position S1 and the exposing position S2 by rotating about the first shaft 43 disposed in the frame 171 and is biased toward the exposing position S2 by the biasing forces of the coil springs 431. Further, the frame 171 has the locking projections 172*b* engageable with the hooks 321 of the locking levers 32, and the locking levers 32 are so constructed as to be shiftable between an engaging position to engage the hooks 321 of the locking levers 32 with the locking projections 172*b* and a disengaging position to disengage the hooks 321 from the locking projections 172*b* by rotating about the second shaft 31 and is biased toward the engaging position by the biasing force of the coil spring 34.

Further, the lock guiding member 95 is so shaped as to free the locking member from being pushed after the locking member is pushed toward the engaging position according to the biasing biasing force of the coil spring 34 while the cover unit 30 is pushed against the biasing forces of the coil springs 431 upon inserting the frame 171 into the apparatus main body 11 with the fixing device 20 covered by the cover unit 30. Thus, the hooks 321 of the locking levers 32 of the locking member are engaged with the locking projections 172*b* of the frame 171 with the cover unit 30 set at the covering position S1 to cover the fixing device 20 by being rotated in the specified direction about the first shaft 43. Since the cover unit 30 is biased toward the exposing position S2 by the biasing forces of the coil springs 431 in this state, the hooks 321 of the locking levers 32 can be stably engaged with the locking projections 172*b* with shaking by these biasing forces.

Further, since the locking levers 32 are biased toward the engaging position to engage the hooks 321 with the locking projections 172*b* by the biasing force of the coil spring 34 while being supported rotatably about the second shaft 31, the hooks 321 of the locking levers 32 can be stably engaged with the locking projections 172*b* by the biasing force of the coil spring 34. By operating this locking member toward the disengaging position to disengage the hooks 321 from the locking projections 172*b* against the biasing force of the coil spring 34, the hooks 321 are disengaged from the locking projections 172*b*, enabling the cover unit 30 to shift from the covering position S1 to the exposing position S2.

Even if the cover unit 30 set at the covering position S1 is not securely locked by the hooks 321 of the locking levers 32, the hooks 321 of the locking levers 32 of the locking member can be securely engaged with the locking projections 172*b* of the frame 171 as the frame 171 is pushed into the apparatus main body 11 since the lock guiding member 95 is so shaped as to free the locking member from being pushed after the locking member is pushed toward the disengaging position against the biasing force of the coil spring 34 while the cover unit 30 is pushed against the biasing forces of the coil springs 431 upon inserting the frame 171 into the apparatus main body 11 with the fixing device 20 covered by the cover unit 30. Further, when the frame 171 is completely pushed into the apparatus main body 11, the lock guiding member 95 stops relatively pushing the cover unit 30 and the operating portion of the locking member, whereby the cover unit 30 can be stably held at the covering position S1 by the biasing force of the coil spring 34.

The present invention is not limited to the above embodiment and also embraces the following contents (1) to (6).

Figure 16:
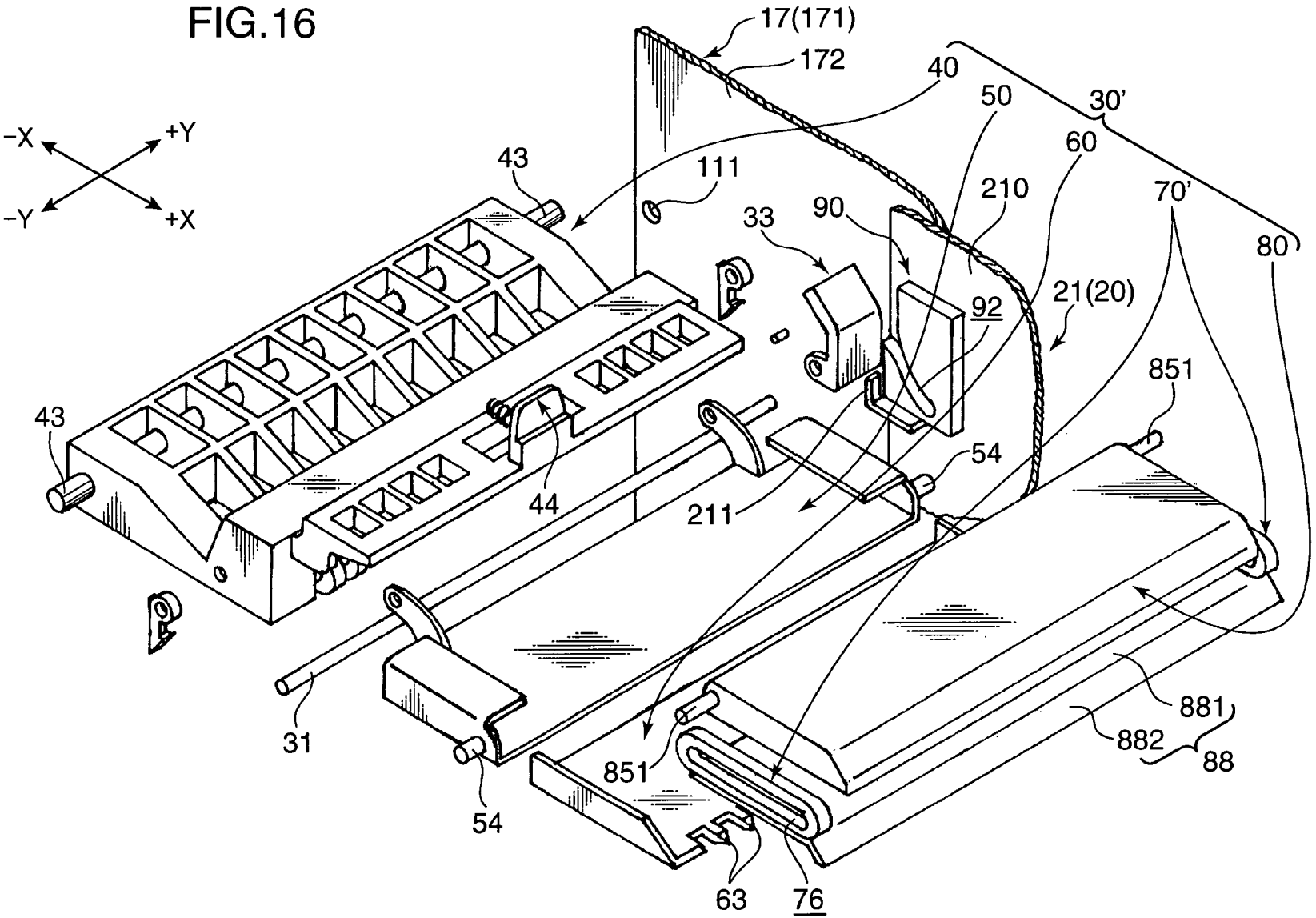
FIG. 16 is an exploded perspective view showing another embodiment of the cover unit.
Figures 17A, 17B:
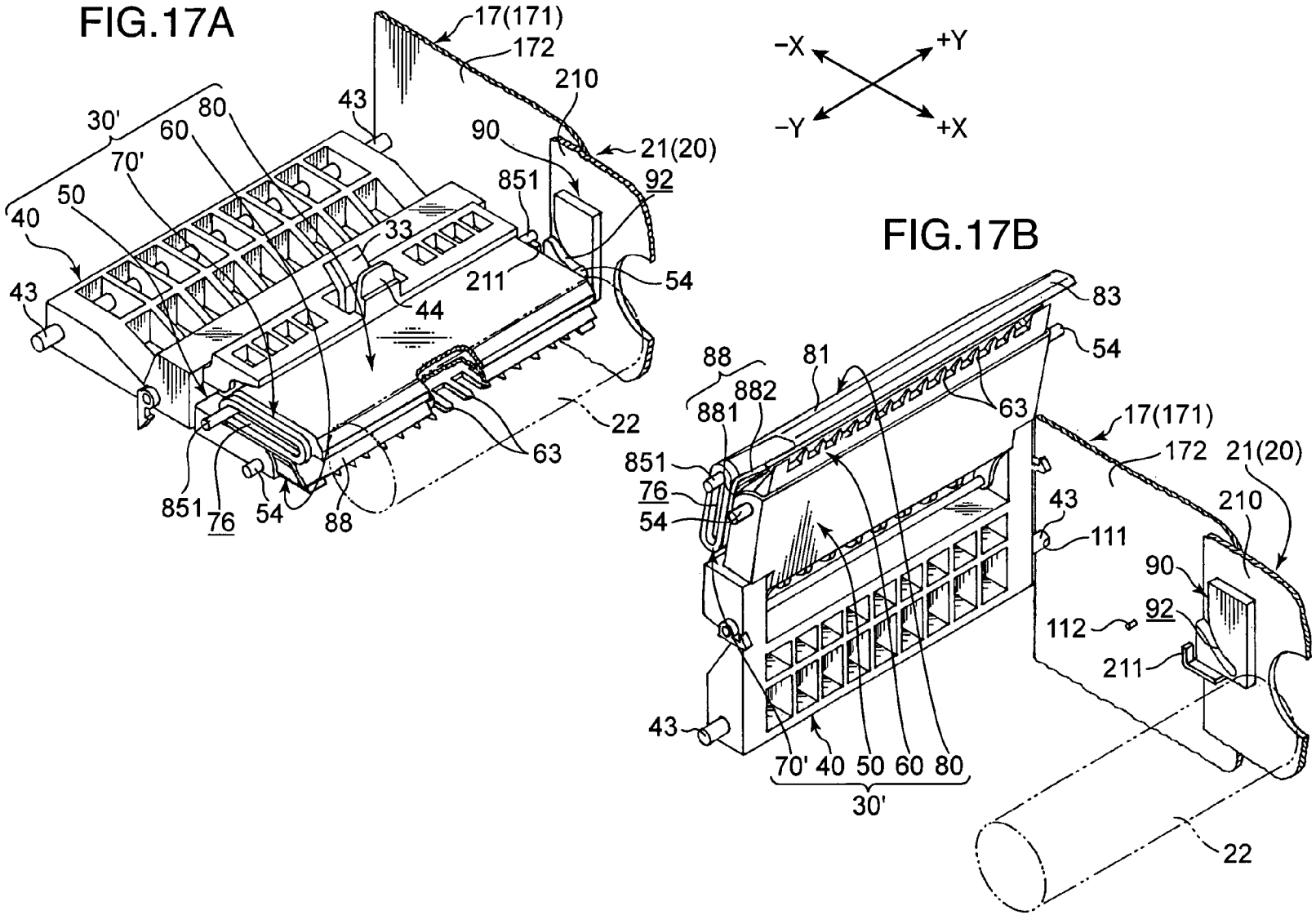

(1) FIG. 16 is an exploded perspective view showing a cover unit 30' according to another embodiment, and FIGS. 17A and 17B are assembled perspective views showing the cover unit 30' shown in FIG. 16, wherein FIG. 17A shows a state where the cover unit 30' is accommodated at an accommodated position in the apparatus main body 11 and FIG. 17B shows a state where the cover cover unit 30' is withdrawn from the accommodated position in the apparatus main body 11. It should be noted that, in FIGS. 16 and 17, X-X directions and Y-Y directions are respectively referred to as transverse directions and forward and backward directions and particularly −X direction is leftward direction, +X direction rightward direction, −Y direction forward direction and +Y direction backward direction.

This embodiment differs from the preceding embodiment in that a protection cover 88 is provided below a covering member 80 and annular guiding members 70' are employed as a cover-unit side guiding members. The protection cover 88 is comprised of a flat portion 881 to bridge side plates 52 of a supporting plate 50 and an oblique portion 882 extending obliquely downward toward the leading end from the right edge of the flat portion 881.

Each annular guiding member 70' has a length set equal to the transverse dimension of the protection cover 88 and is formed with a guiding hole 76 extending in transverse direction. The covering member 80 is transversely movable while being guided by the annular guiding members 70' by inserting the respective ends of a shaft 851 of the covering member 80 into the corresponding guiding holes 76 with the annular guiding members 70' fixed onto the opposite front and rear ends of the flat portion 881 of the protection cover 88. Further, leaf springs 55 for pressing the covering member 80 to the right are provided on provided on the flat portion 881 of the protection cover 88.

Stoppers 211 are disposed at positions on the side walls 210 of the fixing-device main body 21 facing the shaft 851 and interfere with the shaft 851 with the cover unit 30' located at the accommodated position. This embodiment does not include anything corresponding to the second guidable pieces 86 of the preceding embodiment. The other construction of the cover unit 30' of this embodiment is the same as in the preceding embodiment except dimensional differences.

Figure 18A:
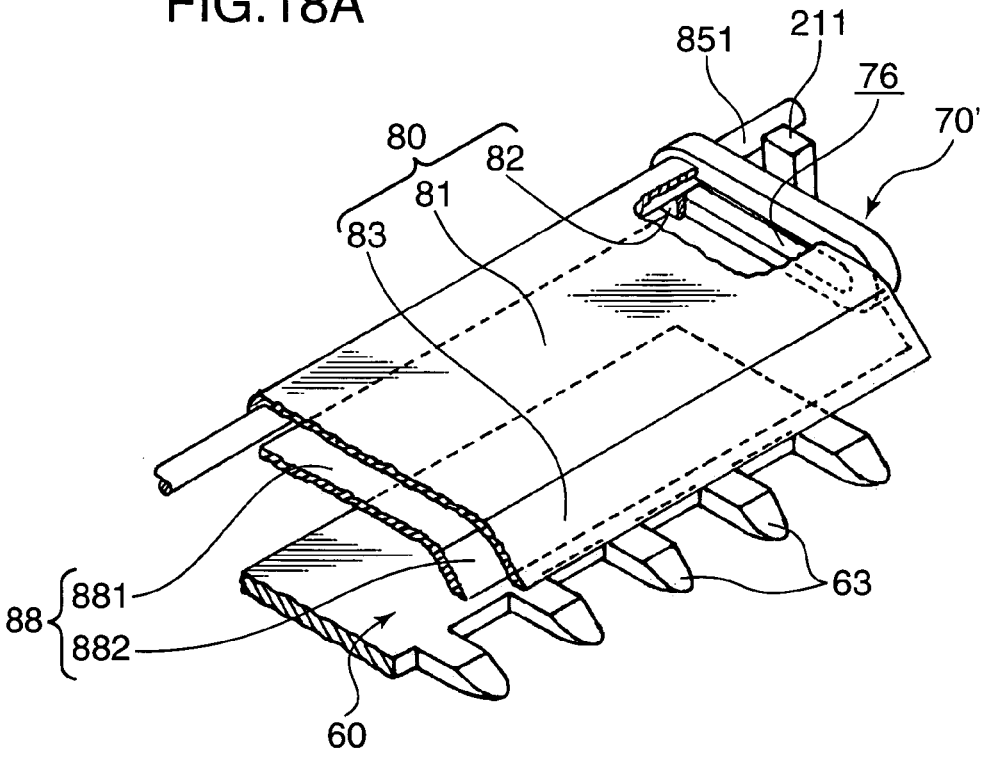
Figure 18B:
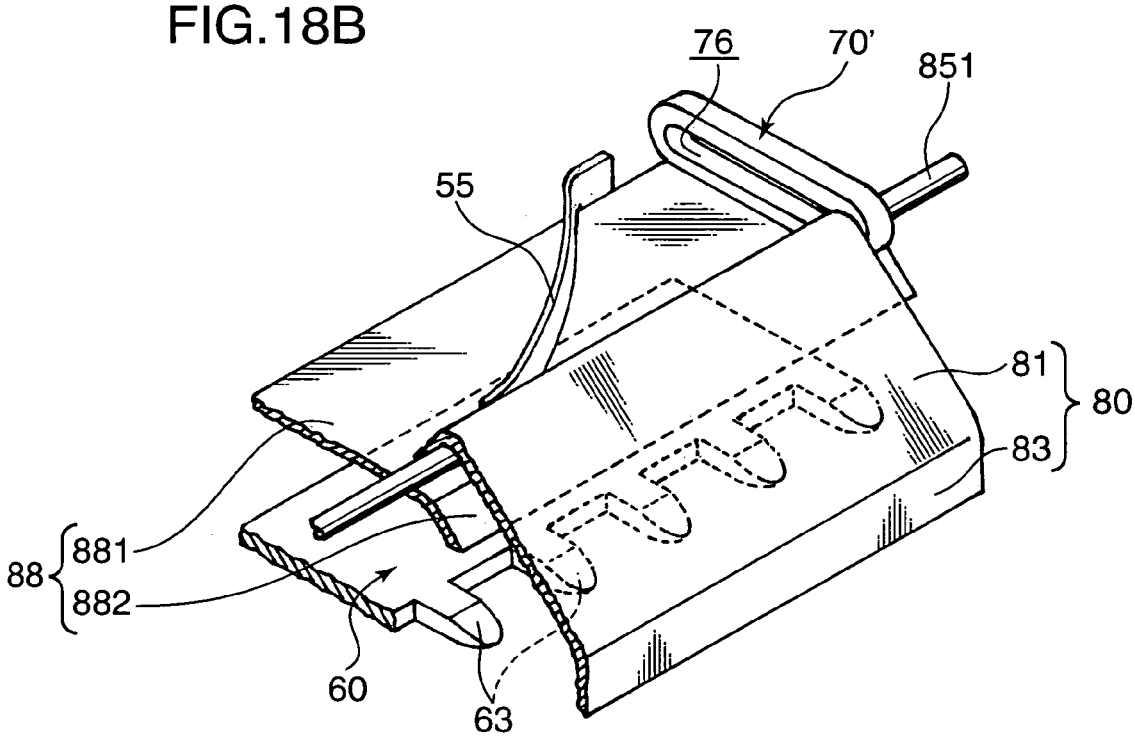

FIGS. 18A and 18B are perspective views showing functions of a construction for changing the position of the covering member 80, wherein FIG. 18A shows a state where the covering member 80 is set at a retracted position and FIG. 18B shows a state where the covering member 80 is set at a covering position.

According to the cover unit 30' of this embodiment, with the cover unit 30' set at the accommodated position (see FIG. 17A), the shaft 851 is relatively pushed by the stoppers 211 to move to the left end positions of the guiding holes 76 of the annular guiding members 70' as shown in FIG. 18A. In this way, the covering member 80 is placed over the protection cover 88.

If the rotating piece 33 and the cover-main-body side operating piece 44 are gripped and lifted up in this state, the supporting plate 50 moves to the left, whereby the shaft 851 relatively moves to the right in the guiding holes 76 by being pushed by the leaf springs 55 to reach the right ends of the guiding holes 76. When the shaft 851 reaches the right ends of the guiding holes 76, the covering member 80 is rotated in clockwise direction about the shaft 851 by biasing forces of torsion coil springs 87 (see FIG. 5). As a result, the covering member 80 comes to cover the tips of the separating claws 63 as shown in FIG. 18B.

(2) Although a copier is taken as an example of the image forming apparatus 10 in the foregoing embodiments, the image forming apparatus 10 is not limited to a copier and may be a printer or a facsimile machine according to the present invention.

(3) In the foregoing embodiments, the leaf springs 55 are employed as first biasing means for biasing the covering member 80 toward the heat roller 22. According to the present invention, the first biasing means is not limited to the leaf springs 55 and may be coil springs.

(4) In the foregoing embodiments, the respective separating claws 63 are mounted on the supporting plate 50 at once by mounting the separating member 60, in which a plurality of separating claws 63 are integrally formed at the leading end of the separating-member main body 61, on the supporting plate 50. Instead, the separating claws 63 may be individually directly mounted on the supporting plate 50 using screws or other means other means without employing the separating member 60.

(5) In the foregoing embodiments, the cover-unit side guiding members 70 are separate from the supporting plate 50 and mounted on the respective side plates 52 of the supporting plate 50. Instead, the cover-unit side guiding members 70 may be integrally formed on the side plates 52.

(6) In the foregoing embodiments, the base plate 951 of the lock guiding member 95 is provided with the front and rear oblique edges 951*a*, 951*b* and the rotating piece 33 interferes with these front and rear oblique edges 951*a*, 951*b* to forcibly engage the hooks 321 of the locking levers 32 with the locking projections 172*b*. However, if the biasing force of the coil spring 34 is set sufficiently strong, the hooks 321 can be engaged with the locking projections 172*b* by a downward movement of the cover-main-body side operating piece 44 resulting from the interference with the bulging portion 955 of the lock guiding member 95 upon pushing the sheet conveyance unit 17 into the apparatus main body 11 even if the front and rear oblique edges 951*a*, 951*b* are not particularly provided.

The aforementioned specific embodiments mainly embrace features of the inventions having the following constructions.

A cover-body locking construction according to one aspect of the present invention comprises a specified housing; a frame insertable into and withdrawable from the housing; a structure supported on the frame; and a cover body shiftable between a covering position to cover at least part of the structure and an exposing position to expose the at least part of the structure to the outside by canceling the covered state with the structure withdrawn from the housing, wherein the cover body includes a locking member having a locking portion for locking the cover body set at the covering position into the frame and an operating portion for causing the locking portion to lock and unlock; and the housing includes a lock guiding member shaped to interlock the locking portion with the frame due to the interference with the cover body and the operating portion upon inserting the frame into the housing with the structure covered by the cover body.

With such a construction, a maintenance operation can be applied to the structure or the structure can be replaced by a new one by setting the cover body at the exposing position with the frame withdrawn from the frame. If the frame is pushed into the housing with the cover body shifted from the exposing position to the covering position to cover the structure, the lock guiding member interferes with the cover body and the operating portion of the locking member to forcibly interlock the locking portion with the frame. Thus, even if the frame is pushed into the housing without the locking portion being interlocked with the frame because of the incompletely covering of the structure by the cover body, the locking portion of the cover body can be securely interlocked with the frame as the frame is pushed into the frame is pushed into the housing.

By providing the housing with such a lock guiding member, the locking member of the cover body never fails to be interlocked with the frame if the frame is pushed into the housing. Accordingly, unlike the prior art, there can be prevented an occurrence of such an inconvenience that the frame is pushed into the housing without the cover body being securely fixed to the frame, thereby making it impossible for the cover body to securely fulfill its function.

In the above construction, it is preferable that the cover body is so mounted on the frame as to be shiftable between the covering position and the exposing position by rotating about a first shaft provided in the frame and is biased toward the exposing position by a biasing force of a first biasing member; the frame has an engaging portion engageable with the locking portion of the locking member; the locking member is shiftable between an engaging position to engage the locking portion with the engaging portion and a disengaging position to disengage the locking portion from the engaging portion by rotating about a specified second shaft and is biased toward the engaging position by a biasing force of a specified second biasing member; and the lock guiding member is so shaped as to free the locking member from being pushed after the locking member is pushed toward the engaging position while the cover member is pushed against the biasing force of the first biasing member.

With such a construction, the locking portion of the locking member is engaged with the engaging portion of the frame when the cover body is rotated in a specified direction about the first shaft to be set at the covering position to cover the structure. Since the cover body is biased toward the exposing position by the biasing force of the first biasing member in this state, the locking portion and the engaging portion can be stably engaged without shaking by this biasing force.

Further, since the locking member is biased toward the engaging position to engage the locking portion with the engaging portion by the biasing force of the second biasing member while being rotatably supported about the second shaft, the locking portion and the engaging portion can be stably engaged by the biasing force of the second biasing member. The locking portion is disengaged from the engaging portion by operating the locking member toward the disengaging position against the biasing force of the second biasing member, whereby the cover body can be shifted from the covering position to the exposing position.

Even if the cover body set at the covering position is not securely locked by the locking member, the lock guiding member is so shaped as to free the locking member from being pushed after the locking member is pushed in an acting direction of the biasing force of the second biasing member, i.e. toward the engaging the engaging position while the cover body is pushed against the biasing force of the first biasing member upon inserting the frame into the housing with the structure covered by the cover body. Thus, the locking portion of the locking member can be securely engaged with the engaging portion of the frame by pushing the frame into the housing even if it is difficult to engage the locking portion with the engaging portion by the biasing force of the second biasing member. Further, when the frame is completely pushed into the housing, the lock guiding member stops relatively pushing the cover body and the operating portion of the locking member and, thereafter, the cover body is stably held at the covering position by the biasing forces of the first and second biasing members.

In the above construction, the lock guiding member preferably includes a bulging portion bulging out toward the cover body and elongated in a withdrawing direction of the structure from the housing, the bulging portion having a first slant for gradually interfering with the cover body to push the cover body in answer to a first inserting operation of the structure into the housing and a second slant for gradually separating from the cover body to stop pushing the cover body in response to a second inserting operation following the first inserting operation.

With such a construction, the above function of the lock guiding member to free the locking member from being pushed after after the locking member is pushed toward the engaging position can be realized by a simple construction.

An image forming apparatus according to another aspect of the present invention comprises an apparatus main body having a housing structure; a frame withdrawable from the apparatus main body; a fixing device supported on the frame; and a cover body shiftable between a covering position to cover at least part of the fixing device and an exposing position to expose the at least part of the fixing device to the outside by canceling the covered state with the fixing device withdrawn from the apparatus main body, wherein the cover body includes a locking member having a locking portion for locking the cover body set at the covering position into the frame and an operating portion for causing the locking portion to lock and unlock; and the apparatus main body includes a lock guiding member shaped to interlock the locking portion with the frame due to the interference with the cover body and the operating portion upon inserting the frame into the apparatus main body with the fixing device covered by the cover body.

In this case, the cover body is preferably a cover unit having a sheet guiding surface for discharging a sheet finished with an image fixing operation in the fixing device to the outside of the apparatus main body, and the sheet guiding surface preferably exhibits a sheet guiding function when the cover unit is at the covering position.

With such a construction, when an image forming unit is withdrawn from the apparatus main body of the image forming apparatus for the removal of a jammed sheet or various maintenance operations and is pushed into the apparatus main body after a specified maintenance operation is carried out with the cover unit set at the exposing position by the operation of the locking member, even if the image forming unit is pushed into the apparatus main body without the cover unit being completely shifted to the covering position, the cover unit can be securely set to the covering position by the lock guiding member provided in the apparatus main body and can be locked at the covering position. Accordingly, there can be securely prevented an occurrence of such an inconvenience that the posture of the cover unit becomes unstable because the cover unit is not locked at the covering position and the conveyance of the sheet after the image fixing operation cannot be satisfactorily carried.

This application is based on patent application No. 2005-317497 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and them, and all changes that fall within metes and bounds of the claims, or equivalence of such metes and bounds are therefore intended to embraced by the claims.

What is claimed is:

1. A cover-body locking construction, comprising:

a specified housing;

a frame insertable into and withdrawable from the housing;

a structure supported on the frame; and a cover body shiftable between a covering position to cover at least part of the structure and an exposing position to expose the at least part of the structure to the outside by canceling the covered state with the structure withdrawn from the housing, the cover body including a locking member having a locking portion for locking the cover body set at the covering position into the frame and an operating portion for causing the locking portion to lock and unlock;

wherein the housing includes a lock guiding member shaped to interlock the locking portion with the frame due to interference with the cover body and the operating portion upon inserting the frame into the housing with the structure covered by the cover body;

the cover body is so mounted on the frame as to be shiftable between the covering position and the exposing position by rotating about a first shaft provided in the frame and is biased toward the exposing position by a biasing force of a first biasing member;

the frame has an engaging portion engageable with the locking portion of the locking member;

the locking member is shiftable between an engaging position to engage the locking portion with the engaging portion and a disengaging position to disengage the locking portion from the engaging portion by rotating about a specified second shaft and is biased toward the engaging position by a biasing force of a specified second biasing member; and the lock guiding member is so shaped as to free the locking member from being pushed after the locking member is pushed toward the engaging position while the cover member is pushed against the biasing force of the first biasing member.

2. A cover-body locking construction according to claim 1 wherein:

the lock guiding member includes a bulging portion bulging out toward the cover body and elongated in a withdrawing direction of the structure from the housing, the bulging portion having:

a first slant for gradually interfering with the cover body to push the cover body in response to a first inserting operation of the structure into the housing, and a second slant for gradually separating from the cover body to stop pushing the cover body in response to a second inserting operation following the first inserting operation.

3. An image forming apparatus, comprising:

an apparatus main body having a housing structure;

a frame withdrawable from the apparatus main body;

a fixing device supported on the frame; and a cover body shiftable between a covering position to cover at least part of the fixing device and an exposing position to expose the at least part of the fixing device to the outside by canceling the covered state with the fixing device withdrawn from the apparatus main body, the cover body including a locking member having a locking portion for locking the cover body set at the covering position into the frame and an operating portion for causing the locking portion to lock and unlock;

wherein:

the apparatus main body includes a lock guiding member shaped to interlock the locking portion with the frame due to interference with the cover body and the operating portion upon inserting the frame into the apparatus main body with the fixing device covered by the cover body the cover body is a cover unit having a sheet guiding surface for discharging a sheet finished with an image fixing operation in the fixing device to the outside of the apparatus main body, and the sheet guiding surface exhibits a sheet guiding function when the cover unit is at the covering position.

4. An image forming apparatus according to claim 3, wherein:

the lock guiding member includes a bulging portion bulging out toward the cover body and elongated in a withdrawing direction of the fixing device from the apparatus main body, the bulging portion having:

a first slant for gradually interfering with the cover body to push the cover body in response to a first inserting operation of the fixing device into the apparatus main body, and a second slant for gradually separating from the cover body to stop pushing the cover body in response to a second inserting operation following the first inserting operation.

* * * * *